US008123560B2

(12) United States Patent
McAlonis et al.

(10) Patent No.: US 8,123,560 B2
(45) Date of Patent: Feb. 28, 2012

(54) MODULAR CONNECTOR SYSTEM

(75) Inventors: Matthew Richard McAlonis, Elizabethtown, PA (US); William Wade Haymaker, Harrisburg, PA (US); Dustin Belack, Hummelstown, PA (US); Michael James Horning, Washington Boro, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 12/791,657

(22) Filed: Jun. 1, 2010

(65) Prior Publication Data

US 2011/0294348 A1 Dec. 1, 2011

(51) Int. Cl.
*H01R 13/648* (2006.01)

(52) U.S. Cl. ..... 439/607.23; 439/607.13

(58) Field of Classification Search ..... 439/607.23, 439/607.13, 607.12, 607.06, 607.39, 607.4, 439/607.5, 607.25

See application file for complete search history.

(56) References Cited

U.S. PATENT DOCUMENTS

| | | | | |
|---|---|---|---|---|
| 5,775,946 | A * | 7/1998 | Briones | 439/607.25 |
| 6,641,438 | B1 * | 11/2003 | Billman | 439/607.07 |
| 6,699,071 | B1 * | 3/2004 | Hyland | 439/607.19 |
| 6,808,419 | B1 * | 10/2004 | Korsunsky et al. | 439/607.23 |
| 7,261,592 | B2 * | 8/2007 | Korsunsky et al. | 439/541.5 |
| 7,390,219 | B2 * | 6/2008 | Pan | 439/607.13 |
| 2003/0186595 | A1 * | 10/2003 | Provencher et al. | 439/701 |
| 2005/0221677 | A1 * | 10/2005 | Hammond et al. | 439/676 |

* cited by examiner

*Primary Examiner* — Hae Moon Hyeon

(57) ABSTRACT

A connector system includes a first connector comprising a housing holding a plurality of contacts, a second connector comprising a housing holding a plurality of contacts, and a metal shield having walls defining a shielded chamber. The first and second connectors are configured to be mounted to a circuit board in a stacked arrangement next to one another. The first and second connectors are configured to be arranged in a shielded configuration in which the first and second connectors are positioned within the shielded chamber and mounted to the circuit board with the metal shield. The first and second connectors are also configured to be arranged in an unshielded configuration in which the first and second connectors are mounted to the circuit board without the metal shield.

17 Claims, 11 Drawing Sheets

MODULAR CONNECTOR SYSTEM

BACKGROUND OF THE INVENTION

The subject matter herein relates generally to connector systems, and more particularly, to header connectors and receptacle connectors of a connector system.

Some connector systems, such as backplane connector systems, utilize electrical connectors to interconnect two circuit boards, such as a motherboard and daughtercard. Electrical connectors, such as a header connector and a receptacle connector, are mounted on the circuit boards and mated together.

However, known backplane connector systems are not without disadvantages. For instance, typically, the connector systems are designed for operation in relatively benign office environments. The header and receptacle connectors are limited in terms of ruggedness with respect to performance demands in environments outside of a controlled office environment, such as high shock and vibration environments common in particular industries, such as aerospace and defense industries. For example, the signal contacts of one of the connectors typically only provides mating spring contact to one or two sides of the mating contact of the other connector at the separable interface. Additionally, the interface between the connectors and the circuit boards is typically not capable of withstanding high shock and vibration environments.

Furthermore, the header and receptacle connectors of known backplane connector systems have unique connector features that maintain connector signal integrity, which require a specific connector orientation on the circuit board. For example, special keying features are typically provided that limit orientation of the connector on the board and/or with the complementary connector. Keying features are provided to key the connector contacts within the connector housing. Typically, left and right modules are provided to complete a connector offering, resulting in multiple connector housings and assemblies.

Moreover, typical header and receptacle connectors have a primarily plastic housing construction, which has limited shielding benefits and does not provide protection from electrostatic discharge. As such, the connectors leave the digital signals susceptible to security breaches as well as electrostatic discharges during field repair and maintenance.

A need remains for a connector system that provides high speed signal integrity while offering adequate physical protection of the connectors. A need remains for a connector system that can withstand increased shock and vibration levels, while maintaining high speed signal integrity. A need remains for a connector system that is unconstrained with limitations of connector orientation. A need remains for a connector system that provides protection from interferences and/or electrostatic discharge.

BRIEF DESCRIPTION OF THE INVENTION

In one embodiment, a connector system is provided including a first connector comprising a housing holding a plurality of contacts, a second connector comprising a housing holding a plurality of contacts, and a metal shield having walls defining a shielded chamber. The first and second connectors are configured to be mounted to a circuit board in a stacked arrangement next to one another. The first and second connectors are configured to be arranged in a shielded configuration in which the first and second connectors are positioned within the shielded chamber and mounted to the circuit board with the metal shield. The first and second connectors are also configured to be arranged in an unshielded configuration in which the first and second connectors are mounted to the circuit board without the metal shield.

In a further embodiment, a connector system is provided that includes a receptacle connector having a receptacle cavity and a plurality of receptacle contacts held within the receptacle cavity. The connector system also includes a plastic header connector, a shielded header connector and a rugged header connector. The plastic header connector has a housing defining a plastic outer perimeter holding a plurality of header contacts and defining a mating interface. The shielded header connector has a housing and a metal shield surrounding the housing defining a shielded outer perimeter. The housing of the shielded header connector holds a plurality of header contacts, and the header contacts and the shielded outer perimeter defining a mating interface. The rugged header connector has a housing and a rugged metal shell surrounding the housing defining a rugged outer perimeter. The housing of the rugged header connector holds a plurality of header contacts, and the header contacts and the rugged outer perimeter defining a mating interface. The mating interfaces are substantially the same such that the plastic header connector, shielded header connector, and rugged header connector are intermatable with the receptacle connector.

In a further embodiment, a connector system is provided including a header connector holding a plurality of header contacts and having an outer perimeter. The connector system also includes a plastic receptacle connector, a shielded receptacle connector and a rugged receptacle connector. The plastic receptacle connector has a housing defining a plastic outer perimeter and a receptacle cavity. The housing of the plastic header connector holds a plurality of contact modules holding a plurality of receptacle contacts extending into the receptacle cavity. The receptacle contacts and the housing define a mating interlace. The shielded receptacle connector has a housing and a metal shield surrounding the housing and defining a shielded outer perimeter. The housing of the shielded receptacle connector has a receptacle cavity and holds a plurality of contact modules holding a plurality of receptacle contacts extending into the receptacle cavity. The receptacle contacts and the housing define a mating interface. The rugged receptacle connector has a housing and a rugged metal shell surrounding the housing defining a rugged outer perimeter and having a receptacle cavity. The housing of the rugged header connector holds a plurality of contact modules holding a plurality of receptacle contacts extending into the receptacle cavity. The receptacle contacts and the housing define a mating interface. The mating interfaces are substantially the same such that the plastic receptacle connector, shielded receptacle connector, and rugged receptacle connector are intermatable with the header connector.

DETAILED DESCRIPTION OF THE INVENTION

Figure 1:
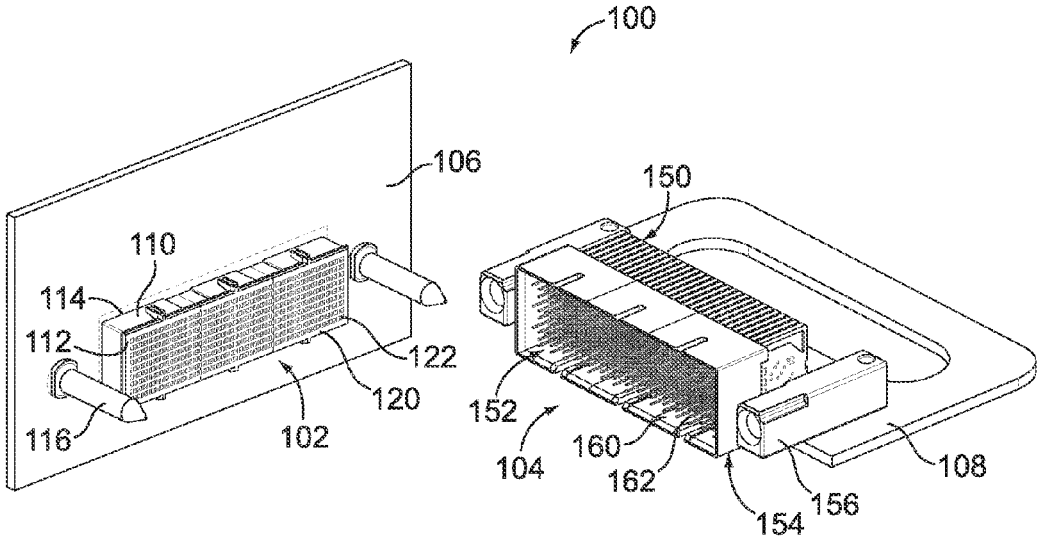
FIG. 1 illustrates a plastic connector system formed in accordance with an exemplary embodiment.

Connector systems are illustrated and described herein having different parts and components. The parts and components have common features, sizes and shapes such that the parts and components are interchangeable. For example, the various connectors described herein are intermatable and backwards compatible with other connectors from other systems. The various connectors have common mating interfaces such that the various connectors are mating compatible with corresponding mating halves. The various connectors define interchangeable modules that have different degrees of ruggedness or robustness and/or different degrees of electrical performance, such as bandwidth or data rate.

The various connectors of the connector systems illustrated and described herein are generally one of three types of connectors, namely plastic connectors, shielded connectors or rugged connectors. The shielded connectors and the rugged connectors generally define higher performance connectors as compared to the plastic connectors, because such connectors have electrical shielding surrounding the connectors. The shielded connectors generally define more robust connectors as compared to the plastic connectors, as the shielded connectors have a metal casing surrounding the connectors. The rugged connectors generally define more robust connectors as compared to the shielded connectors, as the rugged connectors have a machined metal frame, a diecast frame or another rugged type of frame surrounding the connectors, which is more durable than the metal casing surrounding the shielded connectors.

The various connectors of the connector systems illustrated and described herein generally represent connector assemblies, which include more than one individual connector. The connector assemblies are grouped together as a unit for simultaneously mating with corresponding connector assemblies. The individual connectors may be ganged together and mounted to a circuit board as a unit, or alternatively, may be individually mounted to the circuit board, and then the assembly and circuit board mounted to the corresponding connector assembly as a unit. In exemplary embodiments, the individual connectors are symmetrically designed such that the connectors may be utilized in more than one orientation, such as in 180° orientations. The connectors may be designed to have mechanical and/or electrical reversibility to the circuit board and/or to the corresponding mating half. As such, manufacturing may be simplified. Additionally, assembly may be simplified. Furthermore, part count may be reduced and total product count may be reduced. Optionally, the various connectors may represent end modules that may be provided at one end or the other end of the connector assembly. In exemplary embodiments, the connector may be used at either end. Alternatively, the connector may be designed to be either a right-end or a left-end module. Optionally, the various connectors may represent interior modules that may be used between designated end modules. In exemplary embodiments, the connector systems are expandable such that any number of connectors may be utilized, such as by adding additional interior modules, to achieve a desired configuration and number of contacts. Optionally, the various connectors may be useable as either end modules or interior modules.

The various connectors of the connector systems illustrated and described herein generally represent either header connectors or receptacle connectors. The connectors are board mounted connectors, however one or both of the mating halves of the connectors may be cable mounted rather than board mounted. Optionally, one mating half, such as the header connector, is mounted to a backplane, while the other mating half, such as the receptacle connector, is mounted to a daughtercard. Optionally, one mating half, such as the header connector, may constitute a vertical connector, where the contacts thereof pass straight through the connector, while the other mating half, such as the receptacle connector, may constitute a right-angle connector, where the contacts thereof are bent at 90° within the connector. Having one of the connectors as a right angle connector orients the circuit boards perpendicular to one another. Alternatively, both of the connectors may be right angle connectors such that the circuit boards are oriented parallel and/or coplanar with one another.

FIG. 1 illustrates a connector system 100 formed in accordance with an exemplary embodiment. The connector system 100 includes a header assembly 102 and a receptacle assembly 104. The header assembly 102 is coupled to the receptacle assembly 104. The header assembly 102 is mounted to a circuit board 106. The receptacle assembly 104 is mounted to a circuit board 108. The circuit board 106 may represent a backplane and the circuit board 108 may represent a daughter card.

The header assembly 102 includes a plurality of header connectors 110 mounted to the circuit board 106. In the illustrated embodiment, three header connectors 110 are provided, including opposite end connectors and an interior connector. The header assembly 102 has a mating face 112 configured to be mated to the receptacle assembly 104. The header assembly 102 has a mounting face 114 configured to be mounted the circuit board 106. The mating face 112 and the mounting face 114 are generally parallel to one another. Alternative configurations are possible in alternative embodiments. The header assembly 102 constitutes a vertical connector assembly having contacts that pass straight through the header connectors 110.

In an exemplary embodiment, guide pins 116 extend from the circuit board 106 for guiding mating of the header assembly 102 and the receptacle assembly 104. Alternatively, guide sockets may be provided rather than guide pins. Other types of components, such as power modules, fiber-optic connectors, RF coaxial connectors, keying hardware, and the like may be coupled to the circuit board 106 for mating with corresponding components on the circuit board 108.

Each header connector 110 includes a housing 120 extending between the mating and mounting faces 112, 114. The housing 120 holds a plurality of header contacts 122. The housing 120 is fabricated from a dielectric material, such as a plastic material. The header connector 110 constitutes a plastic connector. The header connector 110 does not include any metal shield surrounding the housing 120 or any protective shell surrounding the housing 120. The ruggedness of the header connector 110 is relatively low as compared to other types of connectors described herein. Additionally, the header connector 110 is unshielded.

The header contacts 122 may be arranged in differential pairs. Alternatively, the header contacts 122 may be single ended signal contacts. The header contacts 122 may be signal contacts, ground contacts, power contacts or other types of contacts. The header contacts 122 may be arranged in any pattern and orientation with respect to one another. In an exemplary embodiment, the header contacts 122 are arranged in a matrix of rows and columns.

The receptacle assembly 104 includes a plurality of receptacle connectors 150 mounted to the circuit board 108. In the illustrated embodiment, three receptacle connectors 150 are provided, including opposite end connectors and an interior connector. The receptacle assembly 104 has a mating face 152 configured to be mated to the header assembly 102. The receptacle assembly 104 has a mounting face 154 configured to be mounted the circuit board 108. The mating face 152 and the mounting face 154 are generally perpendicular to one another. Alternative configurations are possible in alternative embodiments. The receptacle assembly 104 constitutes a right angle connector assembly having right angle contacts that extend from perpendicular sides of the receptacle connectors 150.

In an exemplary embodiment, guide sockets 156 extend from the circuit board 108 for guiding mating of the header assembly 102 and the receptacle assembly 104. Alternatively, guide pins may be provided rather than guide sockets. Other types of components, such as power modules, fiber-optic connectors, RF coaxial connectors, keying hardware, and the like may be coupled to the circuit board 108 for mating with corresponding components on the circuit board 106.

Each receptacle connector 150 includes a housing 160 extending between the mating and mounting faces 152, 154. The housing 160 holds a plurality of receptacle contacts 162. The housing 160 is fabricated from a dielectric material, such as a plastic material. The receptacle connector 150 constitutes a plastic connector. The receptacle connector 150 does not include any metal shield surrounding the housing 160 or any protective shell surrounding the housing 160. The ruggedness of the receptacle connector 150 is relatively low as compared to other types of connectors described herein. Additionally, the receptacle connector 150 is unshielded.

The receptacle contacts 162 may be arranged in differential pairs. Alternatively, the receptacle contacts 162 may be single ended signal contacts. The receptacle contacts 162 may be signal contacts, ground contacts, power contacts or other types of contacts. The receptacle contacts 162 may be arranged in any pattern and orientation with respect to one another. In an exemplary embodiment, the receptacle contacts 162 are arranged in a matrix of rows and columns.

Figure 2:
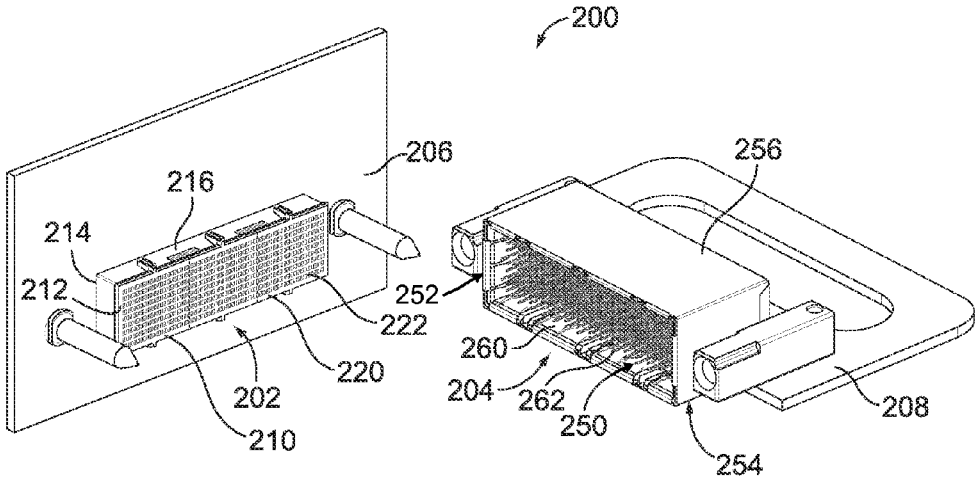
FIG. 2 illustrates a shielded connector system formed in accordance with an alternative embodiment.

FIG. 2 illustrates a connector system 200 formed in accordance with an exemplary embodiment. The connector system 200 includes a header assembly 202 and a receptacle assembly 204. The header assembly 202 is matable with the receptacle assembly 204. The header assembly 202 and the receptacle assembly 204 are similar to the header assembly 102 and the receptacle assembly 104 (both shown in FIG. 1) in some respects, however the header assembly 202 and the receptacle assembly 204 constitute shielded connector assemblies having metal shields that provide electrical shielding. The header assembly 202 is mounted to a circuit board 206. The receptacle assembly 204 is mounted to a circuit board 208. The circuit board 206 may represent a backplane and the circuit board 208 may represent a daughter card.

The header assembly 202 includes a plurality of header connectors 210 mounted to the circuit board 206. In the illustrated embodiment, three header connectors 210 are provided, including opposite end connectors and an interior connector. The header assembly 202 has a mating face 212 configured to be mated to the receptacle assembly 204. The header assembly 202 has a mounting face 214 configured to be mounted the circuit board 206. The mating face 212 and the mounting face 214 are generally parallel to one another. Alternative configurations are possible in alternative embodiments. The header assembly 202 constitutes a vertical connector assembly having contacts that pass straight through the header connectors 210.

In an exemplary embodiment, a metal shield 216 surrounds the header connectors 210. The metal shield 216 may be a stamped and formed metal piece that surrounds the header connectors 210. Optionally, the metal shield 216 may be mounted over the header connectors 210 after the header connectors 210 are coupled to the circuit board 206. Alternatively, the header connectors 210 may be loaded into the metal shield 216, and then the entire unit (header connectors 210 and metal shield 216) mounted to the circuit board 206. In other alternative embodiments, the metal shield 216 may be mounted to the circuit board 206 and then the header connectors 210 loaded therein. The metal shield 216 may include ground pins 218 (shown in FIG. 12) that extend into the circuit board 206, such as into ground vias of the circuit board 206, to electrically ground the metal shield 216. The metal shield 216 provides shielding from interference, such as electromagnetic interference (EMI), electrostatic discharge (ESD), cross-talk, and the like.

Each header connector 210 includes a housing 220 extending between the mating and mounting faces 212, 214. The housing 220 holds a plurality of header contacts 222. The housing 220 is fabricated from a dielectric material, such as a plastic material. The metal shield 216 surrounds the housings 220. When assembled, the header assembly 202 constitutes a shielded connector assembly. The metal shield 216 provides some mechanical protection to the header connectors 210, such as protection from impact, as well as adding stability to the header assembly 202 by holding the individual header connectors 210 together. The metal shield 216 may be secured to the circuit board 206, such as by the ground pins 218, to help hold the header assembly 202 on the circuit board 206, which may make the header assembly 202 more rugged, such as by resisting shock or vibration. The ruggedness of the header assembly 202 is higher than the plastic version, namely the header assembly 102 (shown in FIG. 1).

The header contacts 222 may be arranged in differential pairs. Alternatively, the header contacts 222 may be single ended signal contacts. The header contacts 222 may be signal contacts, ground contacts, power contacts or other types of contacts. The header contacts 222 may be arranged in any pattern and orientation with respect to one another. In an exemplary embodiment, the header contacts 222 are arranged in a matrix of rows and columns.

In an exemplary embodiment, the header connectors 210 and the header contacts 222 are substantially identical to the header connectors 110 and the header contacts 122, respectively (shown in FIG. 1). The difference is that the metal shield 216 is utilized with the header assembly 202. The header connectors 210 and the header contacts 222 are interchangeable with the header connectors 110 and the header contacts 122. A reduced part count is thus achieved by not needing different header connectors and different header contacts with the shielded version as compared to the plastic version. Additionally, because the header connectors 210 and the header contacts 222 are substantially identical to the header connectors 110 and the header contacts 122, the header connectors 210 and the header contacts 222 may be mated with the receptacle connectors 150 and the receptacle contacts 162 (both shown in FIG. 1). The header assembly 202 is backward compatible with the receptacle assembly 104 (shown in FIG. 1).

The receptacle assembly 204 includes a plurality of receptacle connectors 250 mounted to the circuit board 208. In the illustrated embodiment, three receptacle connectors 250 are provided, including opposite end connectors and an interior connector. The receptacle assembly 204 has a mating face 252 configured to be mated to the header assembly 202. The receptacle assembly 204 has a mounting face 254 configured to be mounted the circuit board 208. The mating face 252 and the mounting face 254 are generally perpendicular to one another. Alternative configurations are possible in alternative embodiments. The receptacle assembly 204 constitutes a right angle connector assembly having right angle contacts that extend from perpendicular sides of the receptacle connectors 250.

In an exemplary embodiment, a metal shield 256 surrounds the receptacle connectors 250. The metal shield 256 may be a stamped and formed metal piece that surrounds the receptacle connectors 250. Optionally, the receptacle connectors 250 may be loaded into the metal shield 256, and then the entire unit (receptacle connectors 250 and metal shield 256) mounted to the circuit board 208. Alternatively, the metal shield 256 may be mounted over the receptacle connectors 250 after the receptacle connectors 250 are coupled to the circuit board 208. The metal shield 256 may include ground pins that extend into the circuit board 208, such as into ground vias of the circuit board 208, to electrically ground the metal shield 256. The metal shield 256 provides shielding from interference, such as EMI, ESD, cross-talk, and the like.

Each receptacle connector 250 includes a housing 260 extending between the mating and mounting faces 252, 254. The housing 260 holds a plurality of receptacle contacts 262. The housing 260 is fabricated from a dielectric material, such as a plastic material. The metal shield 256 surrounds the housings 260. When assembled, the receptacle assembly 204 constitutes a shielded connector assembly. The metal shield 256 provides some mechanical protection to the receptacle connectors 250, such as protection from impact, as well as adding stability to the receptacle assembly 204 by holding the individual receptacle connectors 250 together. The metal shield 256 may be secured to the circuit board 208, such as by the ground pins, to help hold the receptacle assembly 204 on the circuit board 208, which may make the receptacle assembly 204 more rugged, such as by resisting shock or vibration. The ruggedness of the receptacle assembly 204 is higher than the plastic version, namely the receptacle assembly 104 (shown in FIG. 1).

The receptacle contacts 262 may be arranged in differential pairs. Alternatively, the receptacle contacts 262 may be single ended signal contacts. The receptacle contacts 262 may be signal contacts, ground contacts, power contacts or other types of contacts. The receptacle contacts 262 may be arranged in any pattern and orientation with respect to one another. In an exemplary embodiment, the receptacle contacts 262 are arranged in a matrix of rows and columns.

In an exemplary embodiment, the receptacle connectors 250 and the receptacle contacts 262 are substantially identical to the receptacle connectors 150 and the receptacle contacts 162, respectively (shown in FIG. 1). The difference is that the metal shield 256 is utilized with the receptacle assembly 204. The receptacle connectors 250 and the receptacle contacts 262 are interchangeable with the receptacle connectors 150 and the receptacle contacts 162. A reduced part count is thus achieved by not needing different receptacle connectors and different receptacle contacts with the shielded version as compared to the plastic version. Additionally, because the receptacle connectors 250 and the receptacle contacts 262 are substantially identical to the receptacle connectors 150 and the receptacle contacts 162, the receptacle connectors 250 and the receptacle contacts 262 may be mated with the header connectors 110 and the header contacts 122 (both shown in FIG. 1). The receptacle assembly 204 is backward compatible with the header assembly 102 (shown in FIG. 1).

Figure 3:
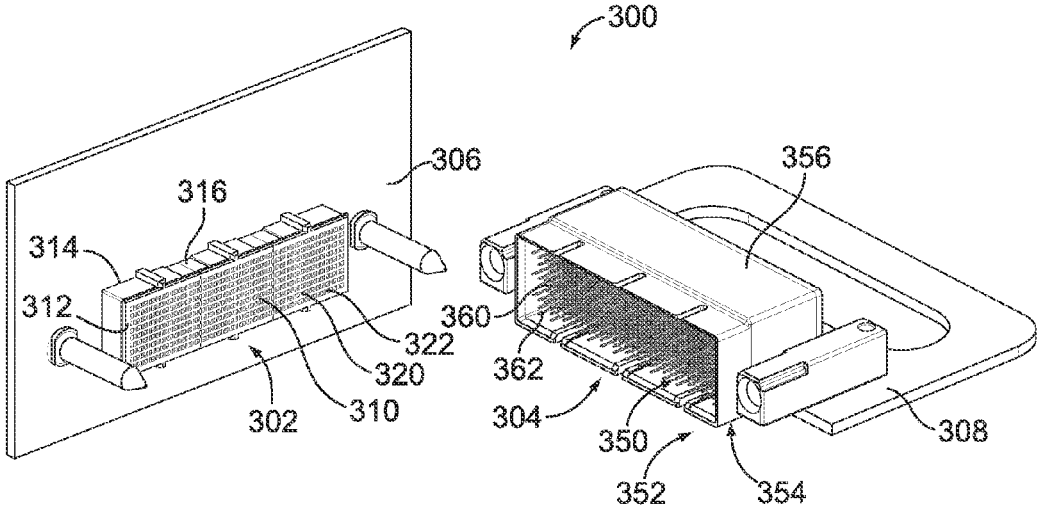
FIG. 3 illustrates a rugged connector system formed in accordance with a further embodiment.

FIG. 3 illustrates a connector system 300 formed in accordance with an exemplary embodiment. The connector system 300 includes a header assembly 302 and a receptacle assembly 304. The header assembly 302 is matable with the receptacle assembly 304. The header assembly 302 and the receptacle assembly 304 are similar to the header assembly 102 and the receptacle assembly 104 (both shown in FIG. 1) in some respects, however the header assembly 302 and the receptacle assembly 304 constitute rugged connector assemblies having rugged shells, such as machined metal or diecast shells, which provide rugged protection and securing as well as electrical shielding.

The header assembly 302 is mounted to a circuit board 306. The receptacle assembly 304 is mounted to a circuit board 308. The circuit board 306 may represent a backplane and the circuit board 308 may represent a daughter card.

The header assembly 302 includes a plurality of header connectors 310 mounted to the circuit board 306. In the illustrated embodiment, three header connectors 310 are provided, including opposite end connectors and an interior connector. The header assembly 302 has a mating face 312 configured to be mated to the receptacle assembly 304. The header assembly 302 has a mounting face 314 configured to be mounted the circuit board 306. The mating face 312 and the mounting face 314 are generally parallel to one another. Alternative configurations are possible in alternative embodiments. The header assembly 302 constitutes a vertical connector assembly having contacts that pass straight through the header connectors 310.

In an exemplary embodiment, a shell 316 surrounds the header connectors 310. The shell 316 may he a machined metal piece or diecast metal piece that surrounds the header connectors 310. Other forming operations or processes may be used in alternative embodiments. Other types of materials, such as synthetic materials like rubber, may be used in alternative embodiments. The synthetic materials may be metalized, such as by being impregnated with metal particles or flakes, or by coating or plating the shell. Optionally, the header connectors 310 may be loaded into the shell 316, and then the entire unit (header connectors 310 and shell 316) mounted to the circuit board 306. Alternatively, the shell 316 may be mounted over the header connectors 310 after the header connectors 310 are coupled to the circuit board 306. The shell 316 may be electrically grounded to the circuit board 306. The shell 316 may provide shielding from interference, such as EMI, ESD, cross-talk, and the like. The shell 316 may be secured to the circuit board 306 by board locks.

Each header connector 310 includes a housing 320 extending between the mating and mounting faces 312, 314. The housing 320 holds a plurality of header contacts 322. The housing 320 is fabricated from a dielectric material, such as a plastic material. The shell 316 surrounds the housings 320. When assembled, the header assembly 302 constitutes a rugged connector assembly. The shell 316 provides mechanical protection to the header connectors 310, such as protection from impact. The shell 316 adds stability to the header assembly 302 by holding the individual header connectors 310 together as well as by being secured to the circuit board 306 by board locks, which may make the header assembly 302 more rugged, such as by resisting shock or vibration. The ruggedness of the header assembly 302 is higher than the plastic version, namely the header assembly 102 (shown in FIG. 1), and the shielded version, namely the header assembly 202 (shown in FIG. 2).

The header contacts 322 may be arranged in differential pairs. Alternatively, the header contacts 322 may be single ended signal contacts. The header contacts 322 may be signal contacts, ground contacts, power contacts or other types of contacts. The header contacts 322 may be arranged in any pattern and orientation with respect to one another. In an exemplary embodiment, the header contacts 322 are arranged in a matrix of rows and columns.

In an exemplary embodiment, the header connectors 310 and the header contacts 322 are substantially identical to the header connectors 110 and the header contacts 122, respectively (shown in FIG. 1). The difference is that the shell 316 is utilized with the header assembly 302. The header connectors 310 and the header contacts 322 are interchangeable with the header connectors 110 and the header contacts 122. A reduced part count is thus achieved by not needing different header connectors and different header contacts with the shielded version as compared to the plastic version. Alternatively, the header connectors 310 may have a different shaped housing 320 configured to fit into the shell 316. Additionally, the header assembly 302 may have a substantially identical mating interface as the header assemblies 102, 202 (shown in FIGS. 1 and 2, respectively) for mating with the receptacle assemblies 104, 204 (shown in FIGS. 1 and 2, respectively). The header assembly 302 is backward compatible with the receptacle assemblies 104, 204.

The receptacle assembly 304 includes a plurality of receptacle connectors 350 mounted to the circuit board 308. In the illustrated embodiment, three receptacle connectors 350 are provided, including opposite end connectors and an interior connector. Optionally, the end connectors and interior connectors may be substantially identical to one another, such that the connectors are interchangeable. The receptacle assembly 304 has a mating face 352 configured to be mated to the header assembly 302. The receptacle assembly 304 has a mounting face 354 configured to be mounted the circuit board 308. The mating face 352 and the mounting face 354 are generally perpendicular to one another. Alternative configurations are possible in alternative embodiments. The receptacle assembly 304 constitutes a right angle connector assembly having right angle contacts that extend from perpendicular sides of the receptacle connectors 350.

In an exemplary embodiment, a shell 356 surrounds the receptacle connectors 350. The shell 356 may be a machined metal piece or diecast metal piece that surrounds the receptacle connectors 350. Other forming operations or processes may be used in alternative embodiments. Other types of materials, such as synthetic materials like rubber, may be used in alternative embodiments. The synthetic materials may be metalized, such as by being impregnated with metal particles or flakes, or by coating or plating the shell. Optionally, the receptacle connectors 350 may be loaded into the shell 356, and then the entire unit (receptacle connectors 350 and shell 356) mounted to the circuit board 308. Alternatively, the shell 356 may be mounted over the receptacle connectors 350 after the receptacle connectors 350 are coupled to the circuit board 308. The shell 356 may be electrically grounded to the circuit board 308. The shell 356 may provide shielding from interference, such as EMI, ESD, cross-talk, and the like. The shell 356 may be secured to the circuit board 308 by board locks.

Each receptacle connector 350 includes a housing 360 extending between the mating and mounting faces 352, 354. The housing 360 holds a plurality of receptacle contacts 362. The housing 360 is fabricated from a dielectric material, such as a plastic material. The shell 356 surrounds the housings 360. When assembled, the receptacle assembly 304 constitutes a rugged connector assembly. The shell 356 provides mechanical protection to the receptacle connectors 350, such as protection from impact. The shell 356 adds stability to the receptacle assembly 304 by holding the individual receptacle connectors 350 together as well as by being secured to the circuit board 308 by board locks, which may make the receptacle assembly 304 more rugged, such as by resisting shock or vibration. The ruggedness of the receptacle assembly 304 is higher than the plastic version, namely the receptacle assembly 104 (shown in FIG. 1), and the shielded version, namely the receptacle assembly 204 (shown in FIG. 2).

The receptacle contacts 362 may be arranged in differential pairs. Alternatively, the receptacle contacts 362 may be single ended signal contacts. The receptacle contacts 362 may be signal contacts, ground contacts, power contacts or other types of contacts. The receptacle contacts 362 may be arranged in any pattern and orientation with respect to one another. In an exemplary embodiment, the receptacle contacts 362 are arranged in a matrix of rows and columns.

In an exemplary embodiment, the receptacle connectors 350 and the receptacle contacts 362 are substantially identical to the receptacle connectors 150 and the receptacle contacts 162, respectively (shown in FIG. 1). The difference is that the shell 356 is utilized with the receptacle assembly 304. The receptacle connectors 350 and the receptacle contacts 362 are interchangeable with the receptacle connectors 150 and the receptacle contacts 162. A reduced part count is thus achieved by not needing different receptacle connectors and different receptacle contacts with the shielded version as compared to the plastic version. Alternatively, the receptacle connectors 350 may have a different shaped housing 360 configured to fit into the shell 356. Additionally, the receptacle assembly 304 may have a substantially identical mating interface as the receptacle assemblies 104, 204 (shown in FIGS. 1 and 2, respectively) for mating with the header assemblies 102, 202 (shown in FIGS. 1 and 2, respectively). The receptacle assembly 304 is backward compatible with the header assemblies 102, 202.

Figure 4:
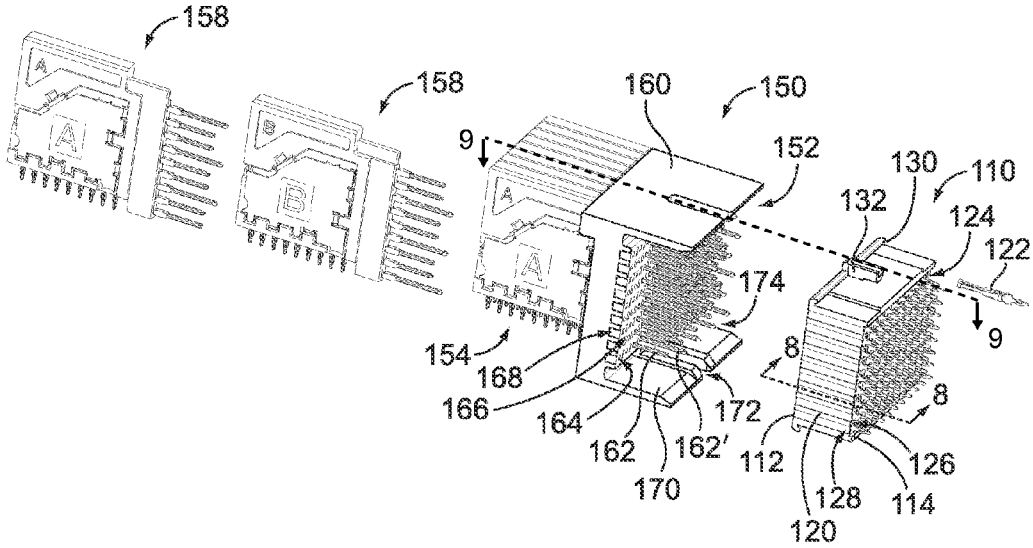
FIG. 4 is an exploded view of a header connector and corresponding receptacle connector of the plastic connector system.

FIG. 4 is an exploded view of one of the header connectors 110 and one of the receptacle connectors 150. The header connector 110 is generally box shaped having opposite top and bottom ends and opposite sides extending between the top and bottom ends. Optionally, the top and bottom ends and the sides may have approximately equal lengths such that the header connector 110 has a square cross section. Alternatively, the sides may be longer or shorter than the top and bottom ends.

The housing 120 includes contact channels 124 extending entirely between the mating face 112 and the mounting face 114. The header contacts 122 are received in corresponding channels 124. Optionally, the header contacts 122 may be loaded through the mounting face 114. Portions of the header contacts 122 extend from the mounting face 114 for mounting to the circuit board 106 (shown in FIG. 1). The contact channels 124 are arranged in rows and columns.

In an exemplary embodiment, air pockets 126 are provided between the contact channels 124 in different columns. Optionally, air pockets may be provided between the rows of contact channels 124 in addition to, or in the alternative to, the air pockets 126 between the columns. The air pockets 126 extend entirely between the mating face 112 and the mounting face 114. The air pockets 126 may be sized and shaped, and positioned, in proximity to the contact channels 124 to control an impedance of the header contacts 122 of the header connector 110. For example, providing the air pockets 126 and/or providing larger air pockets may raise an impedance of the header connectors 122. In an exemplary embodiment, the housing 120 includes a plurality of outer air pockets 128 arranged along the sides of the housing 120. The outer air pockets 128 are open along the sides of the housing 120. When the header connector 110 is stacked next to an adjacent header connector 110, the outer air pockets 128 are aligned with one another and form a common air pocket that is sized and shaped substantially similar to the air pockets 126 that are internal to the housing 120.

The housing 120 includes lips 130 at the top and bottom ends proximate to the mating face 112. The lips 130 may be configured to receive a metal shield in some embodiments, as described in further detail below. The housing 120 includes alignment lugs 132 extending from the top and bottom ends proximate to the mating face 112. The alignment lugs 132 help align the header connector 110 when mated with the receptacle connector 150.

The receptacle connector 150 is generally box shaped having opposite top and bottom ends and opposite sides extending between the top and bottom ends. Optionally, the top and bottom ends and the sides may have approximately equal lengths such that the receptacle connector 150 has a square cross section. Alternatively, the sides may be longer or shorter than the top and bottom ends.

The housing 160 includes contact channels 164 extending therethrough proximate to the mating face 152. The contact modules 158 are loaded into the housing 160 such that the receptacle contacts 162 are received in corresponding channels 164. Optionally, the receptacle contacts 162 may be loaded through a rear end of the housing 160. Portions of the receptacle contacts 162 extend from the mating face 152 for mating with the header contacts 122. The contact channels 164 are arranged in rows and columns.

In an exemplary embodiment, air pockets 166 are provided between the contact channels 164 in different columns. Optionally, air pockets may be provided between the rows of contact channels 164 in addition to, or in the alternative to, the air pockets 166 between the columns. The air pockets 166 extend entirely between the front and the rear ends of the housing 160. The air pockets 166 may be sized and shaped, and positioned, in proximity to the contact channels 164 to control an impedance of the receptacle contacts 162 of the receptacle connector 150. For example, providing the air pockets 166 and/or providing larger air pockets may raise an impedance of the receptacle connectors 162. In an exemplary embodiment, the housing 160 includes a plurality of outer air pockets 168 arranged along the sides of the housing 160. The outer air pockets 168 are open along the sides of the housing 160. When the receptacle connector 150 is stacked next to an adjacent receptacle connector 150, the outer air pockets 168 are aligned with one another and form a common air pocket that is sized and shaped substantially similar to the air pockets 166 that are internal to the housing 160.

The housing 160 includes a hood 170 at the top and bottom ends proximate to the mating face 152. The housing 160 includes alignment slots 172 extending through the hood 170. The alignment slots 172 receive the alignment lugs 132 to help align the receptacle connector 150 when mated with the header connector 110. The housing 160 includes a receptacle cavity 174 defined between the hoods 170. The receptacle cavity 174 receives the header connector 110 therein.

Figure 5:
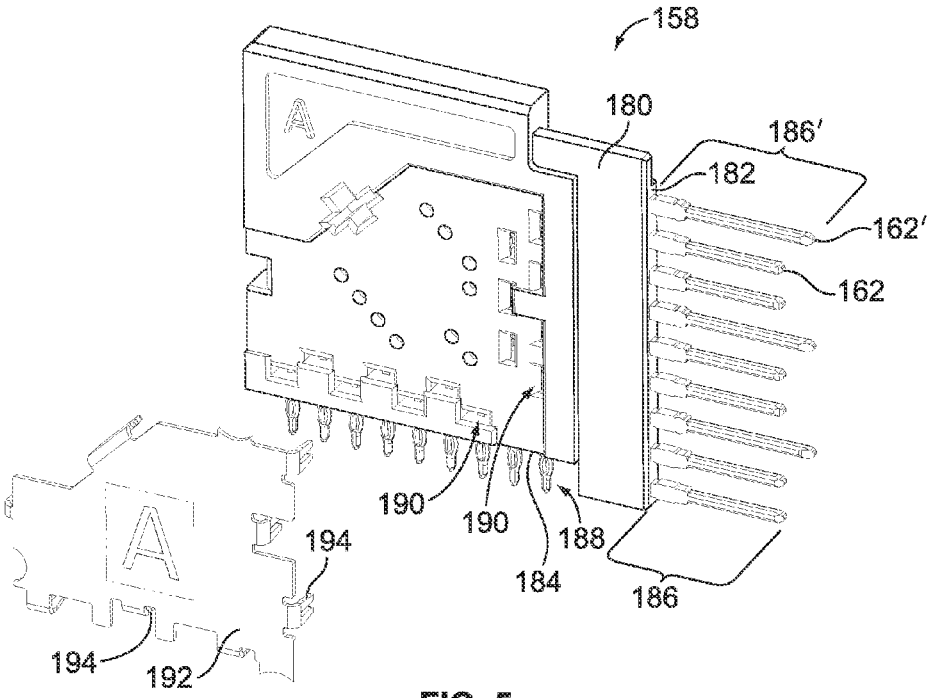
FIG. 5 is a perspective view of a contact module for the receptacle connector shown in FIG. 4.

FIG. 5 is a partially exploded side perspective view of one of the contact modules 158. The contact module 158 includes a dielectric body 180 holding the receptacle contacts 162. In an exemplary embodiment, the receptacle contacts 162 are manufactured as part of a lead frame held by a carrier, and the dielectric body 180 is overmolded over the receptacle contacts 162. Alternative assembly processes or manufacturing processes may be used in alternative embodiments. The dielectric body 180 has a mating face 182 and a mounting face 184, which are generally perpendicular to one another. The contact module 158 defines a right angle contact module with portions of the receptacle contacts 162 being at right angles with one another.

The receptacle contacts 162 include mating pins 186 extending from the mating face 182. The receptacle contacts 162 include mounting tails 188 extending from the mounting face 184. The mating pins 186 are configured to be mated with the header contacts 122. The mounting tails 188 are configured to be loaded into plated vias on the circuit board 108 (shown in FIG. 1). In the illustrated embodiment, the mounting tails 188 constitute press-fit tails, such as eye-of-the-needle tails, that are loaded into the vias and electrically and mechanically secured thereto by an interference fit.

The dielectric body 180 includes a plurality of openings 190 through a side of the dielectric body 180. A ground shield 192 is configured to be mounted to the side of the dielectric body 180. The ground shield 192 provides electrical shielding from an adjacent contact module 158. The ground shield 192 is generally planar and includes barbs 194 extending inward from the ground shield 192. The barbs 194 are received in corresponding openings 190 to contact corresponding receptacle contacts 162. Optionally, the barbs 194 may have opposed fingers similar to insulation displacement contacts that clamp onto opposite sides of the receptacle contacts 162. The barbs 194 are configured to engage the receptacle contacts 162 that define ground contacts, generally referenced as ground receptacle contacts 162'. Each of the ground receptacle contacts 162' is electrically commoned with one another via the ground shield 192. In an exemplary embodiment, the ground receptacle contacts 162' have mating pins 186' that are longer than mating pins 186 of the signal contacts. The receptacle connector 150 is configured for sequence mating with the header connector 110. Optionally, the dielectric body 180 may include more openings 190 than the ground shield 192 includes barbs 194. Less than all of the openings 190 receive barbs 194.

Optionally, different types of contacts modules 158 may be provided. For example, A-type contact modules and B-type contact modules 158 may be used together within the receptacle connector 150. The A and B type contact modules 158 are positioned adjacent to one another such that B-type contact modules 158 are provided between each of the A-type contact modules 158, and vice versa.

The A and B type contact modules 158 may have an identical dielectric body 180 with identical openings 190. The A and B type contact modules 158 may have different ground shields 192 having barbs 194 that are positioned at different locations. When an A-type ground shield 192 is coupled to an A-type contact module 158, the ground shield 192 engages predetermined ones of the receptacle contacts 162. When a B-type ground shield 192 is coupled to a B-type contact module 158, the barbs 194 extend into different openings 190 and engage different ones of the receptacle contacts 162. FIG. 4 illustrates both A and B type contact modules 158. As can be seen in FIG. 4, the ground receptacle contacts 162' (e.g., the longer receptacle contacts 162) have different patterns. When the A and B type contact modules 158 are loaded into the housing 160, the ground receptacle contacts 162' of adjacent contact modules 158 are not aligned with one another.

Figure 6:
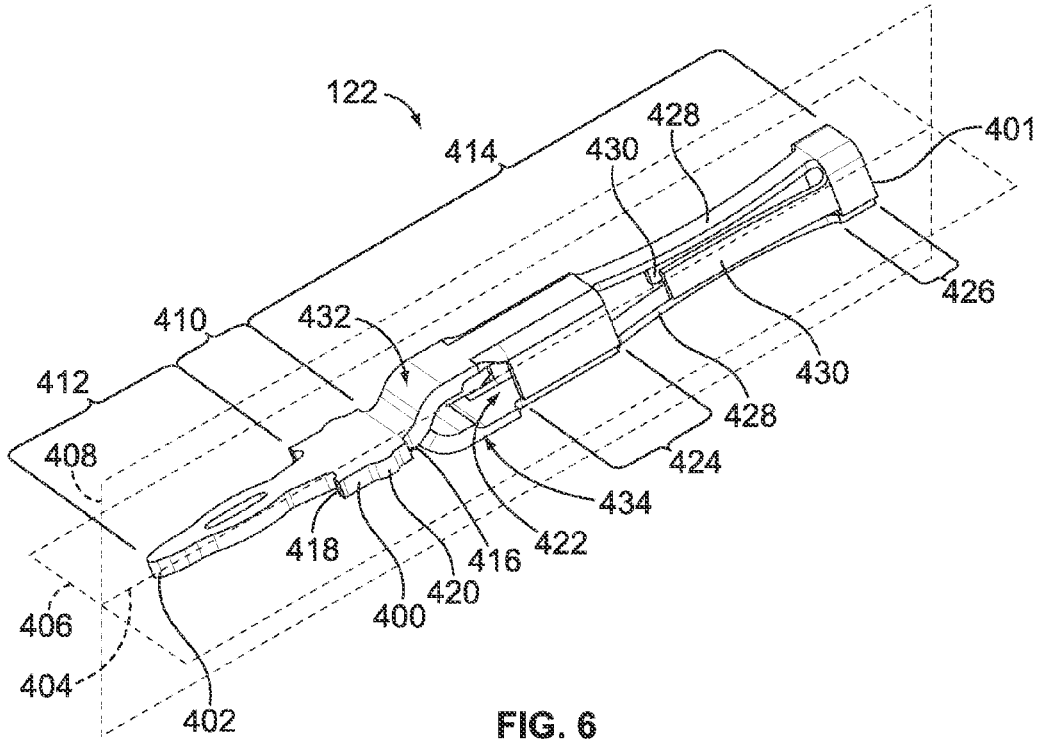
FIG. 6 is a perspective view of a header contact for the header connector shown in FIG. 4.

FIG. 6 is a side perspective view the header contact 122. The header contact 122 includes a contact body 400 extending between a mating end 401 and a mounting end 402 along a longitudinal axis 404. The header contact 122 generally extends along a primary plane 406 and secondary plane 408 that is perpendicular to the primary plane 406 and that intersect along the longitudinal axis 404. In an exemplary embodiment, the header contact 122 is symmetric about the primary plane 406. The header contact 122 is also symmetric about the secondary plane 408.

The header contact 122 includes a base 410, a contact tail 412 extending from the base 410 to the mounting end 402, and a box-shaped socket 414 that extends from the base 410 to the mating end 401. The base 410 is a generally flat, generally rectangular portion of the header contact 122. The base 410 lies within the primary plane 406. The header contact 122 is stamped and formed from a blank sheet of material to form the base 410, contact tail 412, and box-shaped socket 414. The base 410, contact tail 412, and box-shaped socket 414 are integrally formed with one another as a unitary one-piece structure. The base 410, contact tail 412, and box-shaped socket 414 are formed to provide symmetry along both the primary plane 406 and the secondary plane 408. For example, the base 410 and the contact tail 412 are aligned with the central axis of the box-shaped socket 414.

The base 410 includes front shoulders 416 and rear shoulders 418. The header contact 122 is configured to be loaded into the contact channels 124 (shown in FIG. 4) until the front shoulders 416 engage stops within the contact channels 124. The rear shoulders 418 define a bearing surface for pushing the header contact 122 into the contact channel 124. Optionally, the base 410 may include bumps 420 along the outer edges thereof that engage the contact channel 124 to provide an interference fit to hold the header contact 122 within the contact channel 124. When loaded into the contact channel 124, the contact tail 412 extends outward from the contact channel 124 for mounting to the circuit board 106 (shown in FIG. 1).

The box-shaped socket 414 defines a reception area 422 configured to receive the receptacle contact 162 (shown in FIG. 4). The box-shaped socket 414 includes an inner ring 424 and an outer ring 426. The inner and outer rings 424, 426 extend circumferentially around the reception area 422. Optionally, the inner and outer rings 424, 426 enclose the reception area 422 along the corresponding segment of the longitudinal axis 404. The box-shaped socket 414 includes opposed primary springs 428 extending between the inner and outer rings 424. 426. The box-shaped socket 414 includes opposed secondary springs 430 that extend between the inner and outer rings 424, 426.

In an exemplary embodiment, the primary springs 428 extend entirely between the inner and outer rings 424, 426. The secondary springs 430 extend partially between the inner and outer rings 424, 426. For example, the secondary springs 430 may extend from the outer ring 426 towards the inner ring 424, but stop short of the inner ring 424 such that the secondary springs 430 do not engage the inner ring 424. The secondary springs 430 are cantilevered beams that are configured to be deflected when engaging the receptacle contact 162. The primary and secondary springs 428, 430 generally have a concave shape between the inner and outer rings 424, 426. The primary and secondary springs 428, 430 extend at least partially into the reception area 422. The cross-sectional area of the reception area 422, within the inner and outer rings 424, 426, is larger than the cross-sectional area of the reception area 422 along the primary and secondary springs 428, 430.

When the receptacle contact 162 is loaded into the reception area 422, the receptacle contact 162 engages the primary and secondary springs 428, 430. The primary and secondary springs 428, 430 are at least partially deflected outward by the receptacle contact 162 and are held against the receptacle contact 162 by a biasing force or spring force acting on the receptacle contact 162. The primary springs 428 and secondary springs 430 provide four points of contact on the receptacle contact 162. For example, the primary springs 428 engage opposite sides of the receptacle contact 162. Similarly, the secondary springs 430 engage opposite sides of the receptacle contact 162, which are generally perpendicular to the points of contact of the primary springs 428. Having four points of contacts acting in four different directions provides a robust mating interface between the header contact 122 and the receptacle contact 162. The mating interface withstands demanding environments, such as high shock environments and/or vibration. Additionally, having four points of contact provides multiple points of contact, even if one or more should fail and/or be degraded.

The box-shaped socket 414 includes first and second longitudinal extensions 432, 434 extending along opposite, primary sides of the reception area 422. The longitudinal extensions 432, 434 extend between the inner ring 424 and the base 410. The first longitudinal extension 432 is a continuous extension that transitions from the base 410. The second longitudinal extension 434 is separate from, and engages the first longitudinal extension 432 and/or the base 410 proximate to the transition from the first longitudinal extension 432 and the base 410. In an exemplary embodiment, the longitudinal extensions 432, 434 merge toward one another, and engage one another, proximate to the base 410. The first and second longitudinal extensions 432, 434 provide symmetry about the primary plane 406. For example, the first and second longitudinal extensions 432, 434 have complementary shapes and distances from the primary plane 406 along the longitudinal axis 404.

Optionally, the secondary sides of the box-shaped socket 414 between the inner ring 424 and the base 410 are open. Alternatively, such portions of the box-shaped socket 414 may be closed.

Figure 7:
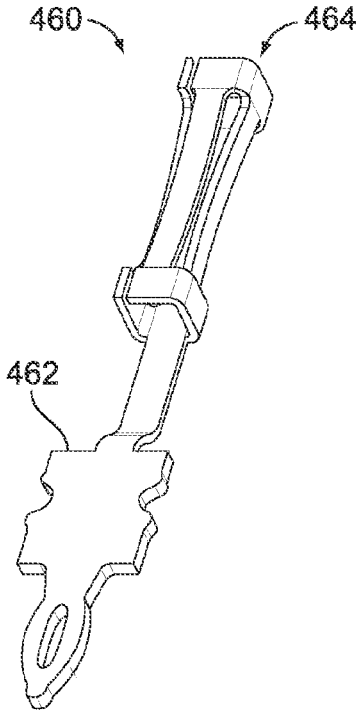
FIG. 7 is a perspective view of an alternative header contact for the header connector shown in FIG. 4.

FIG. 7 is a perspective view of an alternative header contact 460. The header contact 460 is similar to the header contact 122 (shown in FIG. 6), however the header contact 460 does not include a second longitudinal extension. The header contact 460 is not symmetric along the entire length thereof. For example, between a base 462 and a box-shaped socket 464, the header contact 460 is not symmetric, rather, the header contact 460 includes a single longitudinal extension along one side. The box-shaped socket 464 and the base 462 are aligned with one another along the central axis, such that when the header contact 460 is loaded into the header connector 110 (shown in FIG. 1) the mating end and mounting end of the header contact 460 are aligned with one another.

Figure 8:
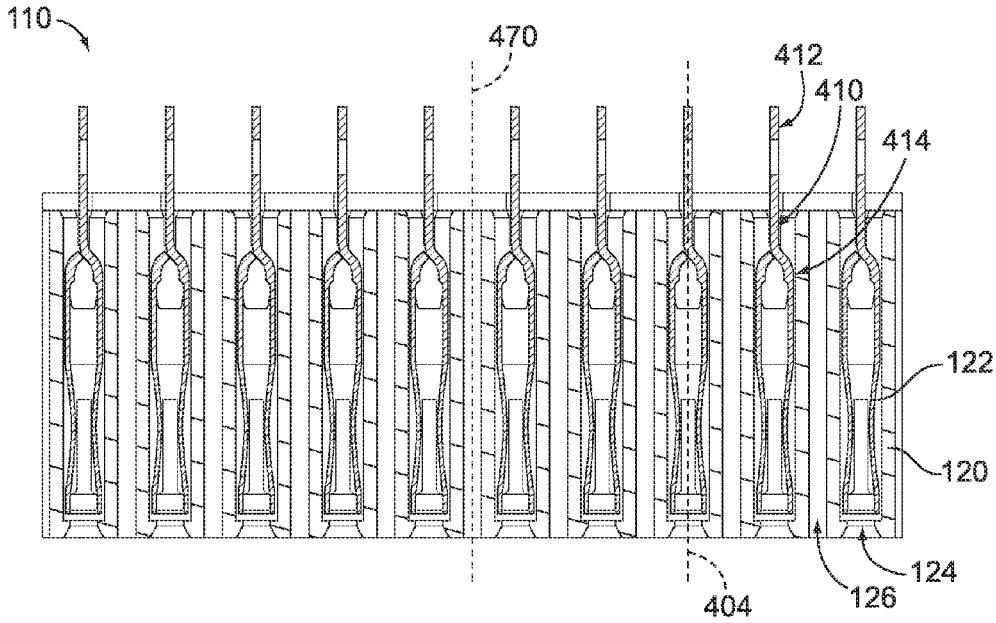
FIG. 8 is a cross sectional view of the header connector taken along line 8-8 shown in FIG. 4.

FIG. 8 is a cross-sectional view of the header connector 110 taken along line 8-8 shown in FIG. 4. The header contacts 122 are shown loaded into the contact channels 124. The header connector 110 is symmetric about a central axis 470 of the header connector 110. For example, an equal number of header contacts 122 are provided on both sides of the central axis 470. Additionally, the spacing between each of the header contacts 122 is the same between each adjacent header contact 122. The air pockets 126 are the same size across the entire housing 120.

As shown in FIG. 8, the header contacts 122 are symmetric about the longitudinal axis 404. For example, the box-shaped socket 414 is substantially identical on both sides of the longitudinal axis 404. Additionally, the base 410 and the contact tail 412 extend along the longitudinal axis 404.

Figure 9:
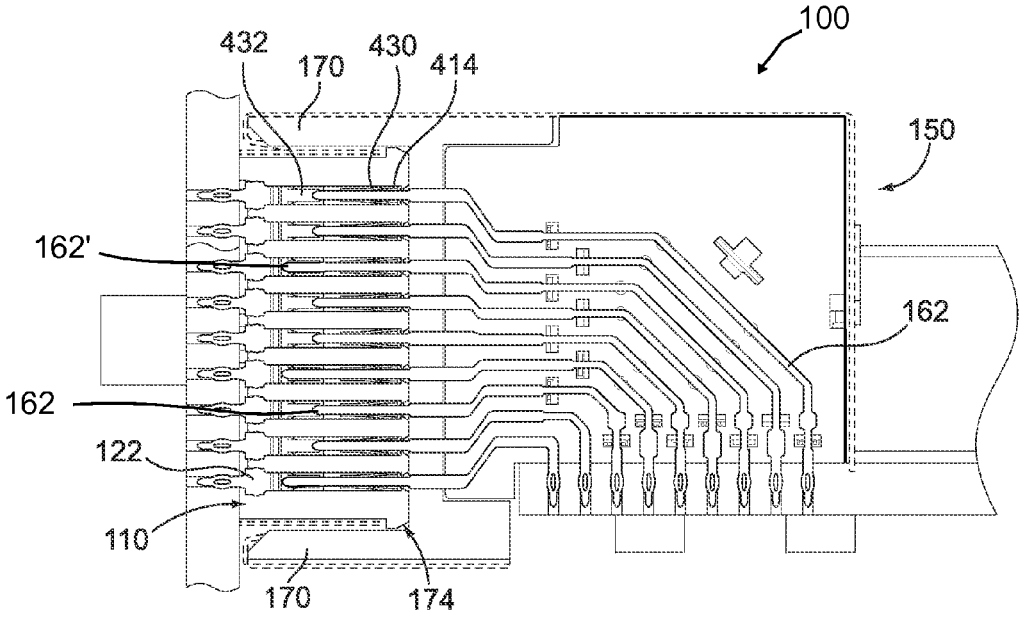
FIG. 9 is a cross sectional view of the plastic connector system taken along line 9-9 shown in FIG. 4 with the header connector and the receptacle connector in an assembled state.

FIG. 9 is a cross-sectional view of the connector system 100 showing the receptacle connector 150 coupled to the header connector 110. When mated, the receptacle contacts 162 are loaded into the box-shaped socket 414 of the corresponding header contacts 122. The secondary springs 430 engage opposite sides of the receptacle contacts 162.

When assembled, the ground receptacle contacts 162' (e.g., the longer receptacle contacts 162) extend further into the box-shaped socket 414 than the signal contacts 162 (e.g. the shorter receptacle contacts 162). The header contacts 122 define either ground header contacts or signal header contacts, depending on which type of receptacle contact 162' or 162 to which the header contact 122 is mated. In an exemplary embodiment, because the receptacle contacts 162 are arranged as differential pairs, within each column, the header contacts 122 are arranged in a ground-signal-signal-ground pattern, with grounds between each pair of signals. The grounds provide electrical shielding between the signals, which increases the performance of the connector system. The air pockets 126 (shown in FIG. 8) are provided between adjacent columns of header and receptacle contacts 122, 162. Having the grounds between the differential pairs of signals allows the header and receptacle contacts 122, 162 to be packaged more densely within the header and receptacle connectors 110, 150. For example, the grounds affect the cross-talk of the header and receptacle contacts 122, 162. Having the air pockets 126, 156 between the columns of header and receptacle contacts 122, 162 allows the header and receptacle contacts 122, 162 to be packaged more densely within the header and receptacle connectors 110, 150. For example, the air pockets 126, 156 affect the impedance of the header and receptacle contacts 122, 162.

The box-shaped sockets 414 are configured to accommodate both the shorter length signal receptacle contacts 162 and the longer length ground receptacle contacts 162'. Different signal and ground header contacts do not need to be provided. Rather, each header contact 122 is substantially identical to one another and can accommodate either a signal receptacle contact 162 or a ground receptacle contact 162' of the receptacle connector 150. The longitudinal extensions 432, 434 extend along the ground receptacle contacts 162. The longitudinal extensions 432, 434 extend along both sides of the ground receptacle contacts 162, and engage each other beyond the end of the ground receptacle contacts 162, to prevent an electrical stub.

When assembled, the header connector 110 is received in the receptacle cavity 174 of the receptacle connector 150. The hood 170 extends along the top and the bottom of the header connector 110. Optionally, a metal shield (shown in phantom) may be coupled to the header connector 110 and a metal shield (shown in phantom) may be coupled to the receptacle connector 150, thus defining shielded versions of the connectors (e.g. defining the header connector 210 and receptacle connector 250, both shown in FIG. 2). Optionally, the metal shield of the receptacle connector 150 may extend along an inner surface of the hood 170 such that the metal shield of the receptacle connector 150 engages the metal shield of the header connector 110. The metal shields may be electrically commoned and grounded to one another. Such electrical commoning may occur prior to the ground receptacle contact 162 being mated with the corresponding header contacts 122.

Figure 10:
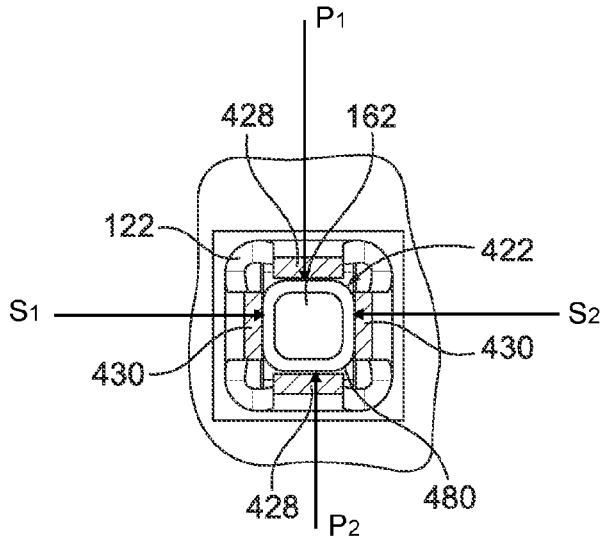
FIG. 10 is a cross sectional view of a mating interface of a header contact and a receptacle contact.

FIG. 10 illustrates one of the receptacle contacts 162 mated to one of the header contacts 122. The receptacle contact 162 includes a generally rectangular outer surface 480. When loaded into the reception area 422, the outer surfaces 480 engage the primary and secondary springs 428, 430. The primary springs 428 press inward on the outer surfaces 480 in generally opposite directions represented by the arrows P1 and P2. Similarly, the secondary springs 430 press inward on the outer surfaces 480 in generally opposite directions represented by the arrows S1 and S2, which are generally perpendicular to the arrows P1 and P2 representing the spring force exerted by the primary springs 428. As such, the springs 428, 430 press against the receptacle contact 162 in four orthogonal directions (e.g. north, south, east and west).

Figure 11:
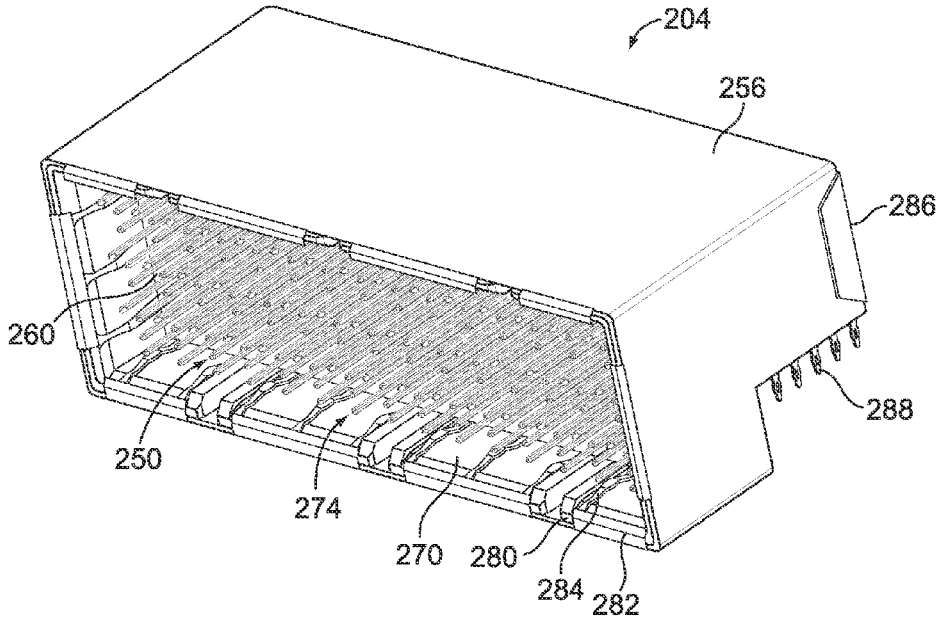
FIG. 11 is a front perspective view of a receptacle assembly for the shielded connector system shown in FIG. 2.

FIG. 11 is a front perspective view of the receptacle assembly 204. The receptacle assembly 204 constitutes a shielded receptacle assembly 204. The metal shield 256 is included to provide the shielding. As shown in FIG. 11, the receptacle connectors 250 are received within the metal shield 256. The metal shield 256 entirely circumferentially surrounds the receptacle connectors 250. For example, the metal shield 256 may extend along the tops, the bottoms, the sides, and the back of the receptacle connector 250. Optionally, a portion of the bottom of the receptacle connector 250 may be open, wherein the metal shield 256 does not extend across such open portion. The mounting ends of the contact modules 158 (shown in FIG. 5) are allowed to extend through the metal shield 256 for mating to the circuit board 208 (shown in FIG. 2). Optionally, the metal shield 256 may extend across a portion of the bottom of the receptacle connectors 250. For example, the portion below the housing 260 may have the metal shield 256 extending there along.

The metal shield 256 includes a front edge 280 having clips 282 extending therefrom. The clips 282 have spring fingers 284 that are received in the receptacle cavity 274. The clips 282 wrap around hoods 270 of the housing 260. The clips 282 hold the position of the receptacle connector 250 within the metal shield 256. The metal shield 256 includes a back wall 286 (only a portion of which is illustrated in FIG. 11) that extends across the back of the receptacle connector 250. The receptacle connectors 250 are captured between the clips 282 and the back wall 286.

The spring fingers 284 are exposed within the receptacle cavity 274. When the header assembly 202 (shown in FIG. 2) is loaded into the receptacle cavity 274, the spring fingers 284 engage the metal shield 216 (shown in FIG. 2).

The spring fingers 284 are electrically connected to the metal shield 216 of the header assembly 202. The receptacle assembly 204 may be electrically commoned with the header assembly 202 via the spring fingers 284. Optionally, the spring fingers 284 may be at least partially deflected when the header assembly 202 is loaded into a receptacle cavity 274 such that the spring fingers 284 are biased against the metal shield 216, thus ensuring electrical connection therebetween. Any number of spring fingers 284 may be provided. The spring fingers 284 may be located anywhere along the perimeter of the receptacle cavity 274. In an exemplary embodiment, the spring fingers 284 are provided along the top, the bottom, and both sides of the receptacle cavity 274.

The metal shield 256 includes a plurality of ground pins 288 extending from the bottom proximate to the sides and/or the back of the metal shield 256. The ground pins 288 are configured to be received in plated vias in the circuit board 208 (shown in FIG. 2). The ground pins 288 provide electrical continuity between the circuit board 208 and the metal shield 256. The ground pins 288 provide mechanical securing of the metal shield 256 to the circuit board 208, which may increase ruggedness of the receptacle assembly 204.

Figure 12:
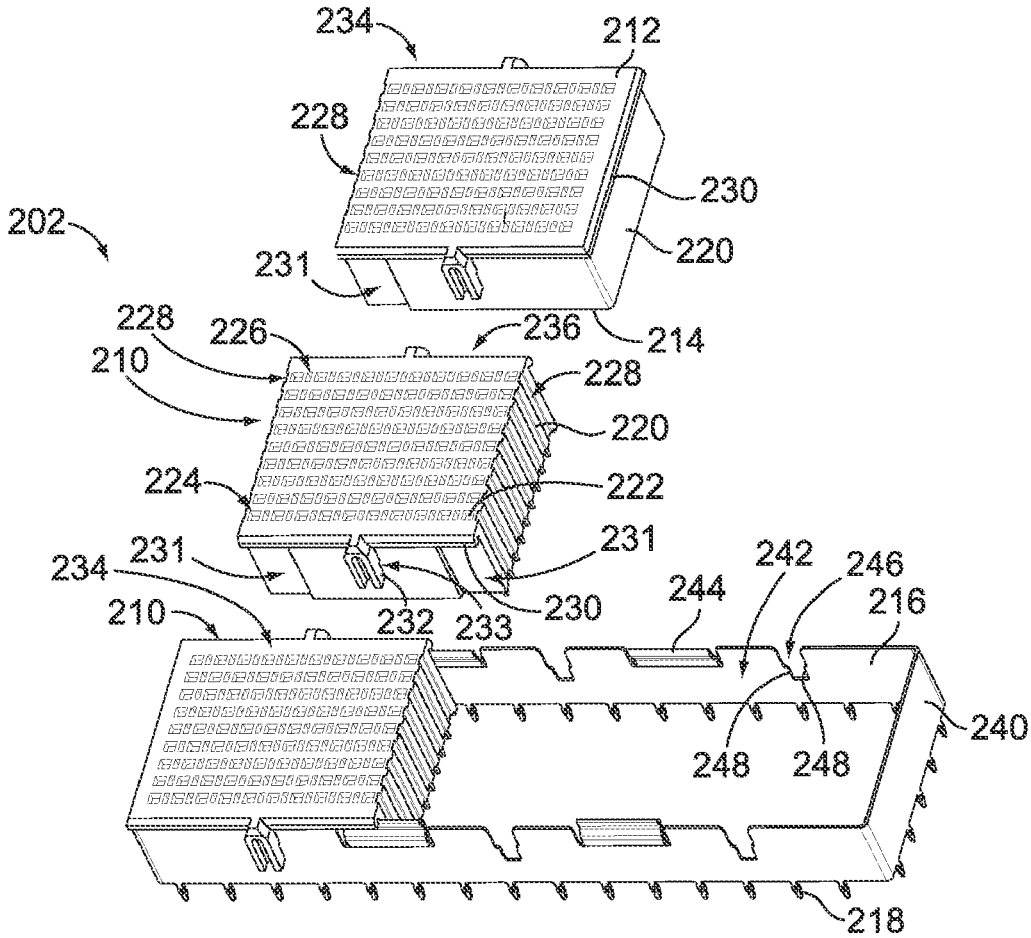
FIG. 12 is a front perspective, partially exploded view of a header assembly for the shielded connector system.
Figure 13:
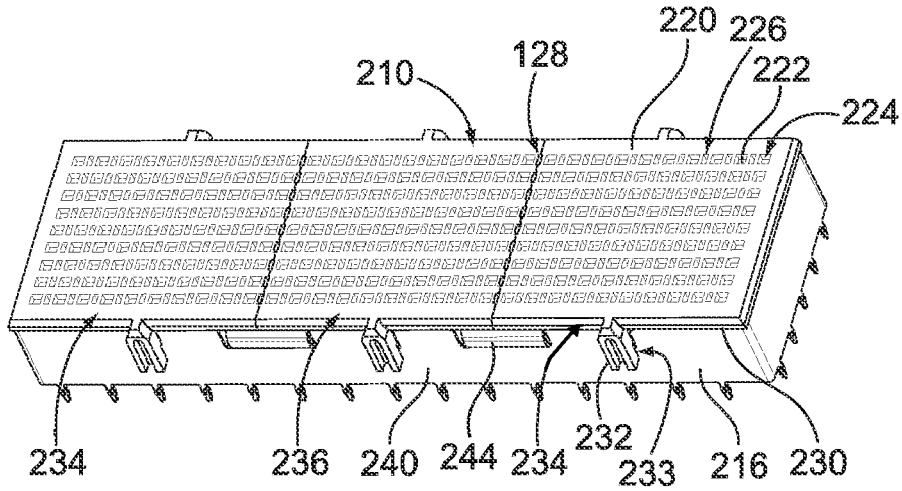
FIG. 13 is a front perspective, assembled view of the header assembly for the shielded connector system.

FIG. 12 is an exploded perspective view of the header assembly 202. FIG. 13 is an assembled view of the header assembly 202. The header connectors 210 are illustrated poised for loading into the metal shield 216. The header connectors 210 may be substantially identical to the header connectors 110 (shown in FIG. 1), such that the header connectors 210, 110 are interchangeable.

The housing 220 includes contact channels 224 extending entirely between the mating face 212 and the mounting face 214. The header contacts 222 are received in corresponding channels 224. Optionally, the header contacts 222 may be loaded through the mounting face 214. Portions of the header contacts 222 extend from the mounting face 214 for mounting to the circuit board 206 (shown in FIG. 2). The contact channels 224 are arranged in rows and columns.

In an exemplary embodiment, air pockets 226 are provided between the contact channels 224 in different columns. Optionally, air pockets may be provided between the rows of contact channels 224 in addition to, or in the alternative to, the air pockets 226 between the columns. The air pockets 226 extend entirely between the mating face 212 and the mounting face 214. The air pockets 226 may be sized and shaped, and positioned, in proximity to the contact channels 224 to control an impedance of the header contacts 222 of the header connector 210.

In an exemplary embodiment, the housing 220 includes a plurality of outer air pockets 228 arranged along the sides of the housing 220. The outer air pockets 228 are open along the sides of the housing 220. When the header connector 210 is stacked next to an adjacent header connector 210, the outer air pockets 228 are aligned with one another and form a common air pocket that is sized and shaped substantially similar to the air pockets 226 that are internal to the housing 220.

The housing 220 includes lips 230 at the top and bottom ends proximate to the mating face 212. The lips 230 engage the metal shield 216. The housing 220 include recesses 231 formed in the top and bottom ends thereof. The recesses 231 are open along the sides of the housing 220. Additionally, the recesses 231 are open along the top or the bottom ends of the housing 220.

The housing 220 includes alignment lugs 232 extending from the top and bottom ends proximate to the mating face 212. The alignment lugs 232 help align the header connector 210 when mated with the receptacle connector 250 (shown in FIG. 11). The alignment lugs 232 engage the metal shield 216, which may secure the housings 220 within the metal shield 216. The alignment lug 232 includes slots 233 formed within the sides of the alignment lug 232 between the alignment lug 232 and the top and bottom ends of the housing 220.

Two different types of header connectors 210 are illustrated in FIG. 12, namely an end connector 234 and an interior connector 236. Two end connectors 234 are loaded into the metal shield 216 to form the header assembly 202. The end connectors 234 are rotated 180° with respect to one another. One or more interior connectors 236 may be provided between the end connectors 234. The number of interior connectors 236 may be selected depending on particular application and the particular number of header contacts 222 that are needed for the particular application. Optionally, the header assembly 202 may not include any interior connectors 236, but rather only include the two end connectors 234.

The end connectors 234 have the lip 230 extending along three sides of the housing 220, whereas the interior connectors 236 have the lip 230 extending only along the top and the bottom ends thereof. Additionally, the interior connectors 236 include outer air pockets 228 on both sides thereof, whereas the end connectors 234 include outer air pockets 228 only on one side thereof. The opposite side is generally flat.

The end connectors 234 include one recess 231 on the top end proximate to an interior side thereof and one recess 231 on the bottom end proximate to the interior side thereof. In contrast, the interior connectors 236 include two recesses 231 on the top end proximate to both sides thereof and two recesses 231 on the bottom end proximate to both sides thereof.

The metal shield 216 includes a plurality of walls 240 that define a shield chamber 242. The ground pins 218 extend downwardly from the bottoms of the walls 240. Any number of ground pins 218 may be provided. Optionally, the positioning of the ground pins 218 may be selected to correspond to a position of the header connectors 210 within the shield chamber 242. For example, ground pins 218 may be aligned with certain ones of the header contacts 222. For example, the ground pins 218 may be aligned with header contacts 222 that constitute signal contacts. Optionally, the header contacts 122 may be arranged within the housing 220 in a ground signal-signal ground pattern. However, because the housing 220 holds nine header contacts 222 within each column, the header contacts 222 may have a pattern that ends with a signal contact at the outermost row. In such cases, the ground pins 218 may be provided aligned within such column either below or above the header contact 222 ending as a signal contact. The ground pins 218 may he provided a predetermined distance from the header contact 222. Optionally, the distance may be the same as the distances between each adjacent header contact 222 such that the contact pitch is maintained.

The metal shield 216 includes a plurality of tabs 244 extending therefrom. The tabs 244 are received in the space defined between the lip 230 and the housing 220. The tabs 244 have a convex shape such that the tabs 244 bulge outward. When the header assembly 202 is loaded into the receptacle cavity 274 (shown in FIG. 11) of the receptacle assembly 204 (shown in FIG. 11) the tabs 244 engage the metal shield 256 (shown in FIG. 11) of the receptacle assembly 204. The tabs 244 may help hold the header connectors 210 within the shield chamber 242.

The metal shield 216 includes a plurality of channels 246 formed therein. Protrusions 248 extend into each of the channels 246. When the header connectors 210 are loaded into the shield chamber 242, the alignment lugs 232 are received in the channels 246. The protrusions 248 are received in the slots 233 defined between the alignment lugs 232 and the walls of the housing 220. The protrusions 248 engage the housing 220 and/or the alignment lug 232 to secure the header connector 210 within the shield chamber 242. For example, the protrusions 248 may engage the alignment lugs 232 in an interference fit. Other securing means and features may be provided in alternative embodiments to secure the header connectors 210 within the shield chamber 242.

As shown in FIG. 13, when the header connectors 210 are loaded into the shield chamber 242, the housings 220 abut against one another. The outer air pockets 128 of adjacent header connectors 210 are aligned with one another and cooperate to define a common air pocket.

Figure 14:
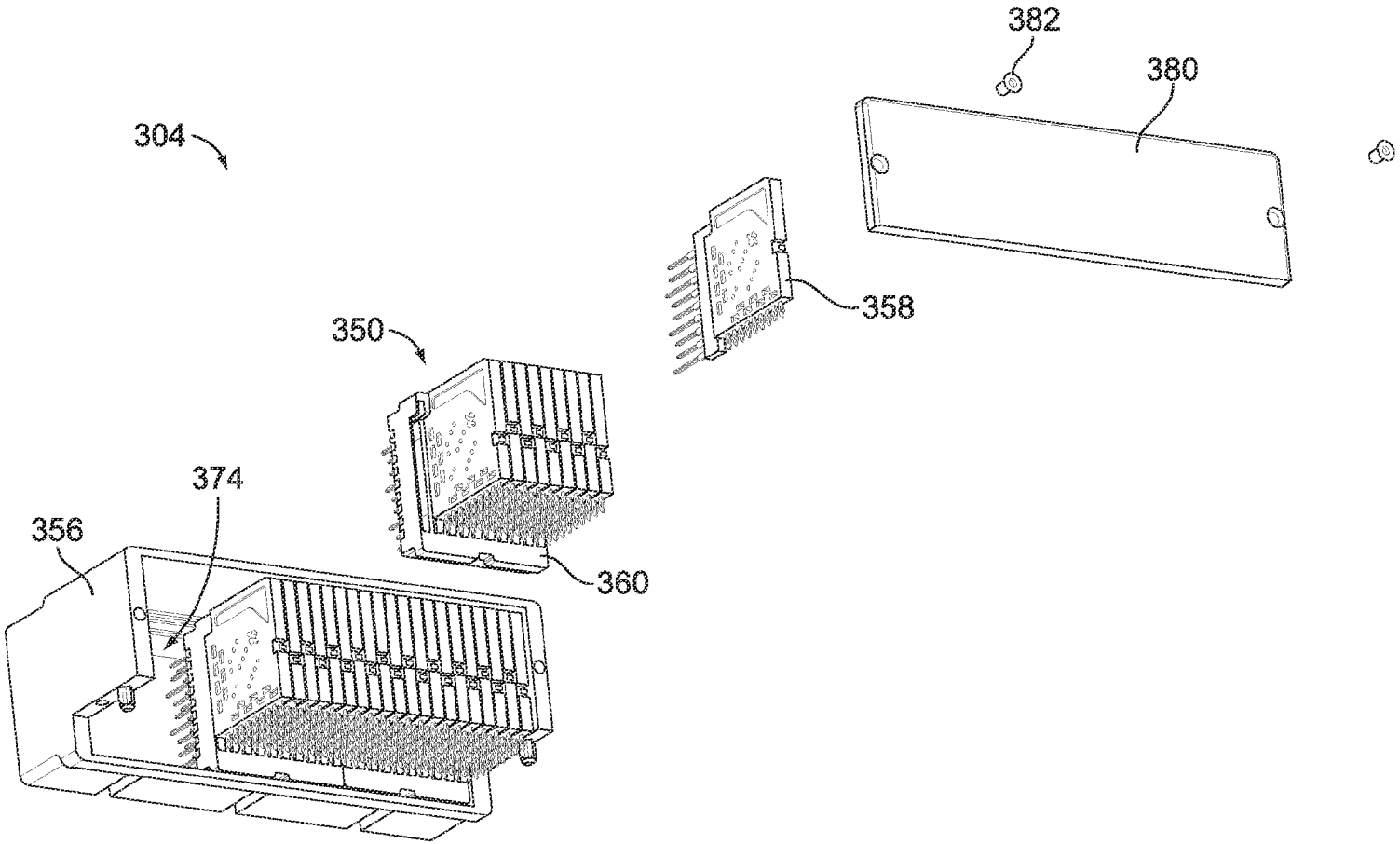
FIG. 14 is a rear perspective, partially exploded view of a receptacle assembly for the rugged connector system shown in FIG. 3.

FIG. 14 is an exploded rear perspective view of the receptacle assembly 304. The receptacle assembly 304 constitutes a rugged receptacle assembly 304. The shell 356 is included to provide the mechanical protection and/or electrical shielding. The shell 356 provides mechanical protection to the receptacle connectors 350, such as protection from impact. The shell 356 adds stability to the receptacle assembly 304 by holding the individual receptacle connectors 350 together as well as by being secured to the circuit board 308 (shown in FIG. 3) by board locks (e.g. fasteners through the circuit board 308 that engage the shell 356 to secure the shell 356 to the circuit board 308), which may make the receptacle assembly 304 more rugged, such as by resisting shock or vibration.

The receptacle connectors 350 are received within the shell 356. Each receptacle connector 350 includes a plurality of contact modules 358 received in the housing 360. The contact modules 358 may be substantially similar to the contact modules 158 (shown in FIG. 4). The contact modules 358, 158 may be interchangeable, which reduces the overall part count of the connector family.

The shell 356 may be a machined metal piece or diecast metal piece that entirely circumferentially surrounds the receptacle connectors 350. For example, the shell 356 may extend along the tops, the bottoms, the sides, and the back of the receptacle connectors 350. In an exemplary embodiment, the shell 356 includes a back cover 380 that extends along the back of the receptacle connectors 350 once the receptacle connectors 350 are loaded into the receptacle cavity 374. The back cover 380 holds the receptacle connectors 350 in the receptacle cavity 374, which may add to the ruggedness of the receptacle assembly 304. The back cover 380 may be secured using fasteners 382, or other securing means or features in alternative embodiments.

Optionally, a portion of the bottom of the receptacle connector 350 may be open, wherein the shell 356 does not extend across such open portion. The mounting ends of the contact modules 358 are allowed to extend through the shell 356 for mating to the circuit board 308 (shown in FIG. 3). Optionally, the shell 356 may extend across a portion of the bottom of the receptacle connectors 350. For example, the portion below the housings 360 may have the shell 356 extending there along.

In the illustrated embodiment, three receptacle connectors 350 are provided, including opposite end connectors and an interior connector. Optionally, the end connectors and the interior connector may be substantially identical to one another, as such, different end connectors and interior connectors do not need to be provided, which reduces the overall part count. Alternatively, the end connectors may have different features than the interior connector.

Figure 15:
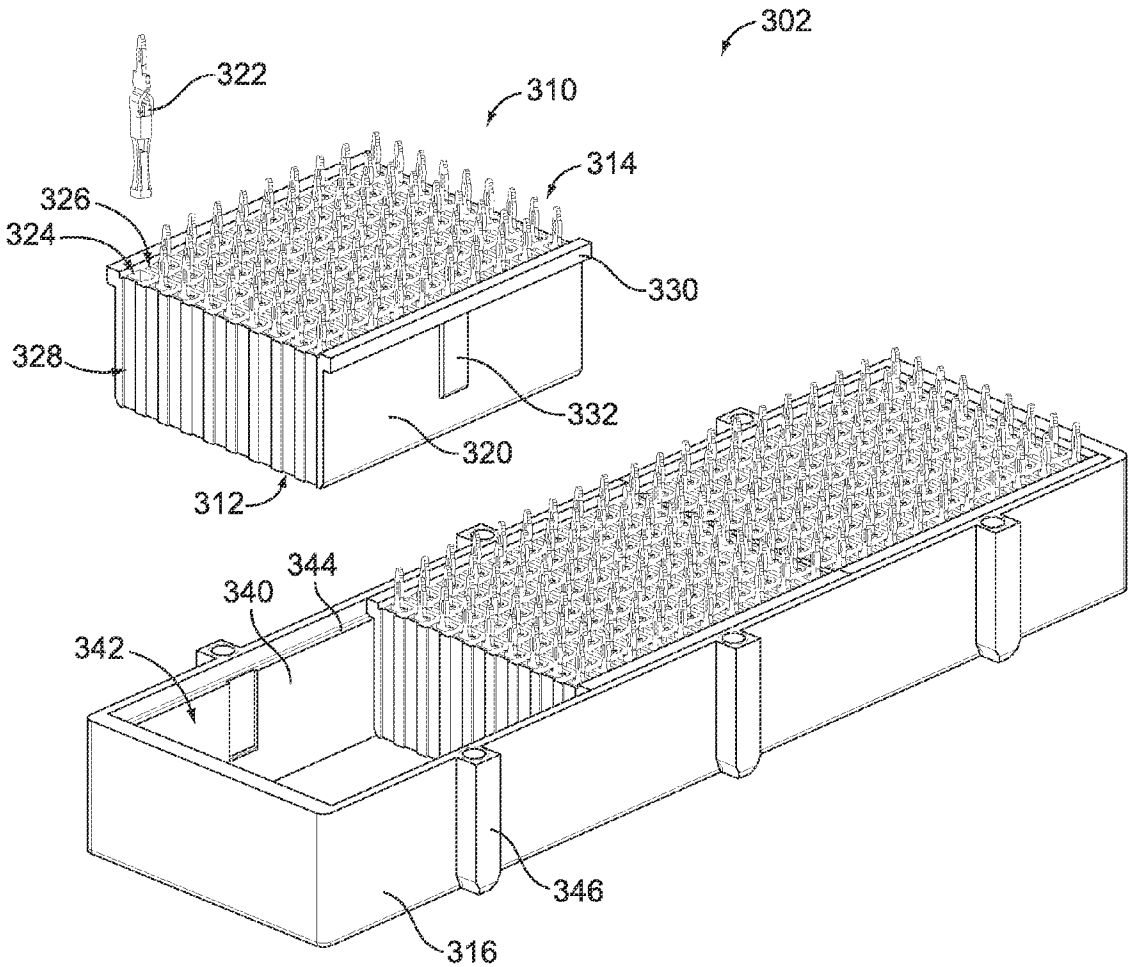
FIG. 15 is a rear perspective, partially exploded view of a header assembly for the rugged connector system.

FIG. 15 is a rear perspective view of the header assembly 302, with one of the header connectors 310 poised for loading into the shell 316. Optionally, each of the header connectors 310 may be identical to one another, as such, different end connectors and interior connectors do not need to be provided, which reduces the overall part count. The header connectors 310 may be substantially identical to the header connectors 110 (shown in FIG. 1) or the header connectors 210 (shown in FIG. 2), such that the header connectors 310 are interchangeable with the header connectors 110 or 210. Alternatively, the header connectors 310 may have different features than the header connectors 110, 210; however the header assembly 302 may provide a substantially similar mating interface for intermatability.

The housing 320 includes contact channels 324 extending entirely between the mating face 312 and the mounting face 314. The header contacts 322 are received in corresponding channels 324. Optionally, the header contacts 322 may be loaded through the mounting face 314. Portions of the header contacts 322 extend from the mounting face 314 for mounting to the circuit board 306 (shown in FIG. 3). The contact channels 324 are arranged in rows and columns.

In an exemplary embodiment, air pockets 326 are provided between the contact channels 324 in different columns. Optionally, air pockets may be provided between the rows of contact channels 324 in addition to, or in the alternative to, the air pockets 326 between the columns. The air pockets 326 extend entirely between the mating face 312 and the mounting face 314. The air pockets 326 may be sized and shaped, and positioned, in proximity to the contact channels 324 to control an impedance of the header contacts 322 of the header connector 310.

In an exemplary embodiment, the housing 320 includes a plurality of outer air pockets 328 arranged along the sides of the housing 320. The outer air pockets 328 are open along the sides of the housing 320. When the header connector 310 is stacked next to an adjacent header connector 310, the outer air pockets 328 are aligned with one another and form a common air pocket that is sized and shaped substantially similar to the air pockets 326 that are internal to the housing 320.

The housing 320 includes shoulders 330 at the top and bottom ends proximate to the mounting face 314. The shoulders 330 engage the shell 316 to position the housings 320 within the shell 316. The housing 320 includes ribs 332 extending from the top and bottom ends. The ribs 332 help align the header connector 310 within the shell 316.

The shell 316 includes a plurality of walls 340 that define a shell chamber 342. The shell 316 includes a ledge 344 proximate to the mounting face 314. The shoulders 330 rest on the ledge 344 to position the housing 320 within the shell chamber 342. The shell 316 includes a plurality of outwardly extending alignment lugs 346 that are oriented and positioned similar to the alignment lugs 132 or 232 (shown in FIGS. 1 and 2, respectively), allowing intermatability of the header assembly 302 with the receptacle assemblies 104, 204 (shown in FIGS. 1 and 2, respectively). The alignment lugs 346 include board locks (e.g. threaded openings that receive threaded fasteners) to secure the shell 316 to the circuit board 306 (shown in FIG. 3).

Figure 16:
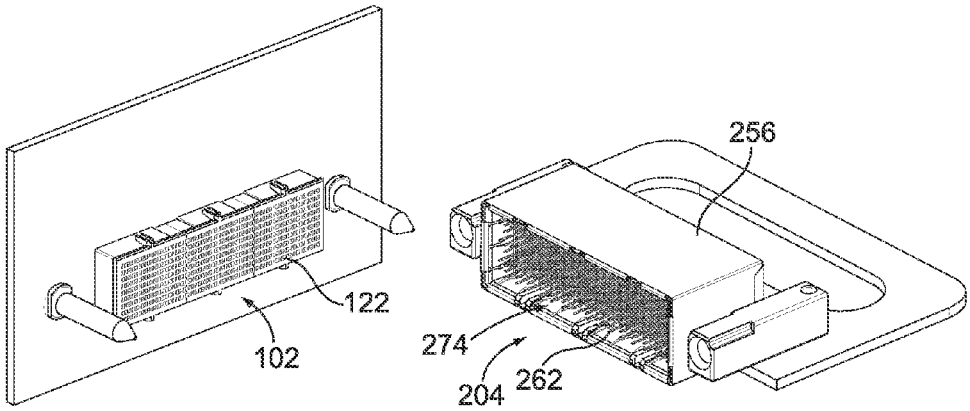
FIG. 16 illustrates a plastic header assembly poised for mating with a shielded receptacle assembly.

FIG. 16 illustrates a plastic header assembly 102 poised for mating with a shielded receptacle assembly 204. When the receptacle assembly 204 is mated to the header assembly 102, the header assembly 102 is received in the receptacle cavity 274. The box-shaped header contacts 122 receive the receptacle contacts 262.

The plastic header assembly 102 fits within the shielded receptacle assembly 204 in the same manner as the plastic header assembly 102 fits within the plastic receptacle assembly 104 (shown in FIG. 1). The mating interfaces are substantially identical such that the plastic receptacle assembly 104 and the shielded receptacle assembly 204 are both configured to receive the plastic header assembly 102. The metal shield 256 of the shielded receptacle assembly 204 provides shielding around the interfaces between the header contacts 122 and the receptacle contacts 262.

Figure 17:
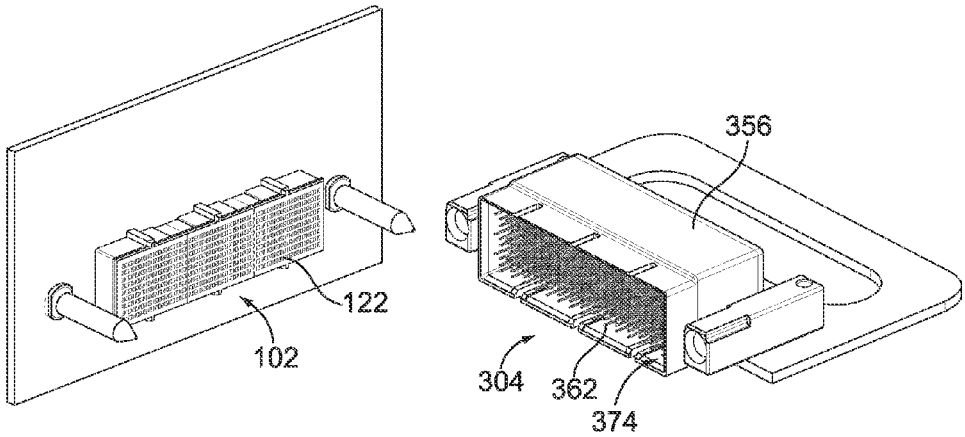
FIG. 17 illustrates a plastic header assembly poised for mating with a rugged receptacle assembly.

FIG. 17 illustrates a plastic header assembly 102 poised for mating with a rugged receptacle assembly 304. When the receptacle assembly 304 is mated to the header assembly 102, the header assembly 102 is received in the receptacle cavity 374. The box-shaped header contacts 122 receive the receptacle contacts 362.

The plastic header assembly 102 fits within the rugged receptacle assembly 304 in the same manner as the plastic header assembly 102 fits within the plastic receptacle assembly 104 (shown in FIG. 1). The mating interfaces are substantially identical such that the plastic receptacle assembly 104 and the rugged receptacle assembly 304 are both configured to receive the plastic header assembly 102. The shell 356 of the rugged receptacle assembly 304 provides shielding around the interfaces between the header contacts 122 and the receptacle contacts 362.

Figure 18:
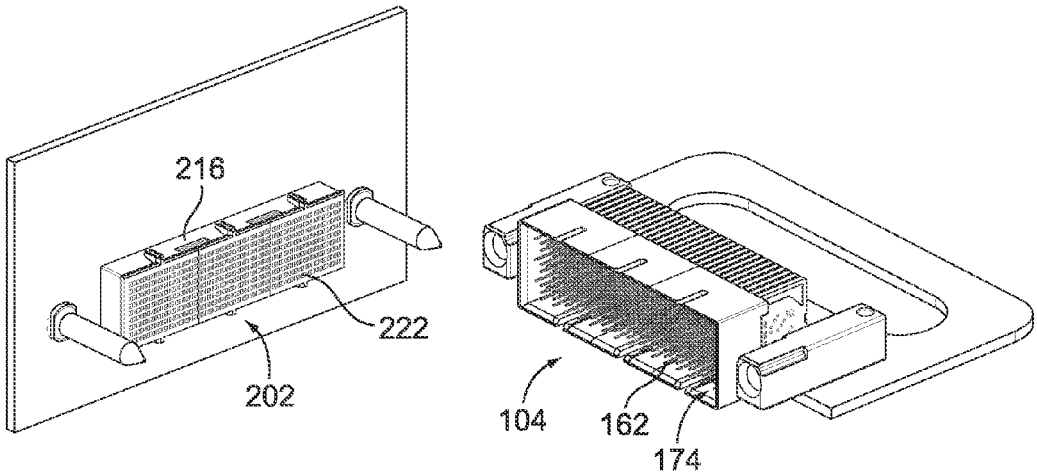
FIG. 18 illustrates a shielded header assembly poised for mating with a plastic receptacle assembly.

FIG. 18 illustrates a shielded header assembly 202 poised for mating with a plastic receptacle assembly 104. When the receptacle assembly 104 is mated to the header assembly 202, the header assembly 202 is received in the receptacle cavity 174. The box-shaped header contacts 222 receive the receptacle contacts 162.

The shielded header assembly 202 fits within the plastic receptacle assembly 104 in the same manner as the shielded header assembly 202 fits within the shielded receptacle assembly 204 (shown in FIG. 2). The mating interfaces are substantially identical such that the plastic receptacle assembly 104 and the shielded receptacle assembly 204 are both configured to receive the shielded header assembly 202. The metal shield 216 of the shielded header assembly 202 provides shielding around the interfaces between the header contacts 222 and the receptacle contacts 162.

Figure 19:
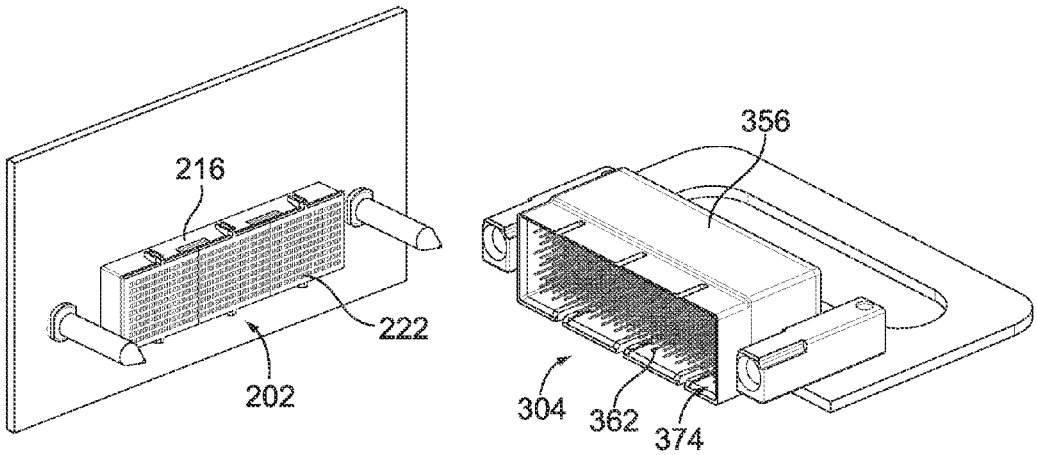
FIG. 19 illustrates a shielded header assembly poised for mating with a rugged receptacle assembly.

FIG. 19 illustrates a shielded header assembly 202 poised for mating with a rugged receptacle assembly 304. When the receptacle assembly 304 is mated to the header assembly 202, the header assembly 202 is received in the receptacle cavity 374. The box-shaped header contacts 222 receive the receptacle contacts 362.

The shielded header assembly 202 fits within the rugged receptacle assembly 304 in the same manner as the shielded header assembly 202 fits within the shielded receptacle assembly 204 (shown in FIG. 2). The mating interfaces are substantially identical such that the rugged receptacle assembly 304 and the shielded receptacle assembly 204 are both configured to receive the shielded header assembly 202. The metal shield 216 of the shielded header assembly 202, as well as the metal shell 356 of the rugged receptacle assembly 304, provides shielding around the interfaces between the header contacts 222 and the receptacle contacts 362.

Figure 20:
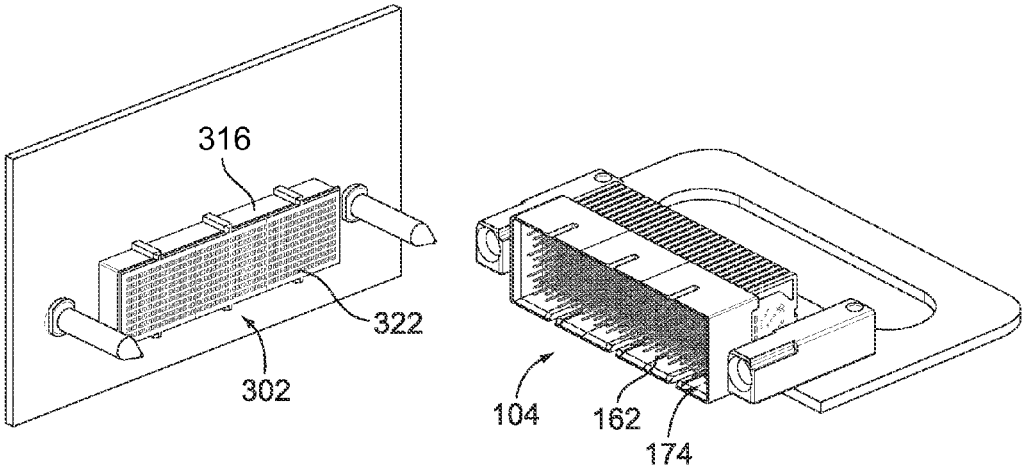
FIG. 20 illustrates a rugged header assembly poised for mating with a plastic receptacle assembly.

FIG. 20 illustrates a rugged header assembly 302 poised for mating with a plastic receptacle assembly 104. When the receptacle assembly 104 is mated to the header assembly 302, the header assembly 302 is received in the receptacle cavity 174. The box-shaped header contacts 322 receive the receptacle contacts 162.

The rugged header assembly 302 fits within the plastic receptacle assembly 104 in the same manner as the rugged header assembly 302 fits within the rugged receptacle assembly 304 (shown in FIG. 3). The mating interfaces are substantially identical such that the plastic receptacle assembly 104 and the rugged receptacle assembly 304 are both configured to receive the rugged header assembly 302. The shell 316 of the rugged header assembly 302 provides shielding around the interfaces between the header contacts 322 and the receptacle contacts 162.

Figure 21:
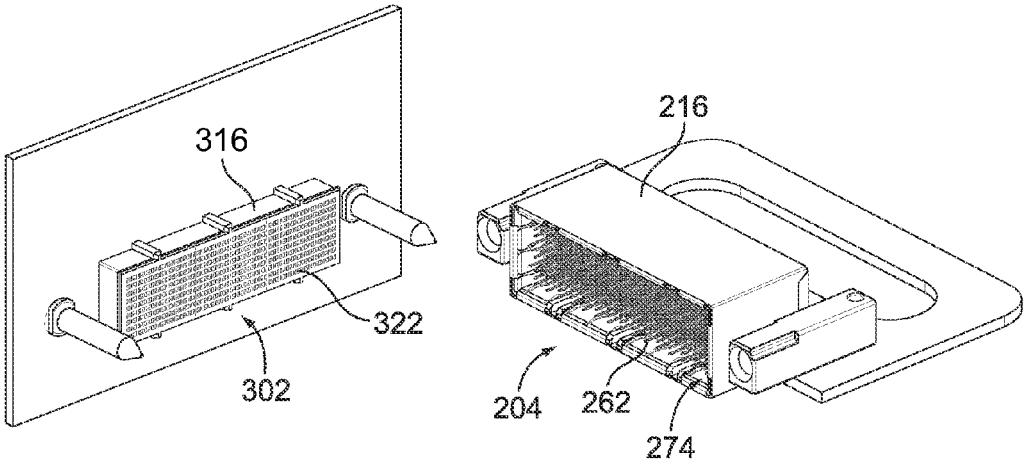
FIG. 21 illustrates a rugged header assembly poised for mating with a shielded receptacle assembly.

FIG. 21 illustrates a rugged header assembly 302 poised for mating with a shielded receptacle assembly 204. When the receptacle assembly 204 is mated to the header assembly 302, the header assembly 302 is received in the receptacle cavity 274. The box-shaped header contacts 322 receive the receptacle contacts 262.

The rugged header assembly 302 fits within the shielded receptacle assembly 204 in the same manner as the rugged header assembly 302 fits within the rugged receptacle assembly 304 (shown in FIG. 3). The mating interfaces are substantially identical such that the shielded receptacle assembly 204 and the rugged receptacle assembly 304 are both configured to receive the rugged header assembly 302. The shell 316 of the rugged header assembly 302, as well as the metal shield 216 of the shielded receptacle assembly 204, provides shielding around the interfaces between the header contacts 322 and the receptacle contacts 262.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means—plus-function format and are not intended to be interpreted based on 35 U.S.C. §112, sixth paragraph, unless and until such claim limitations expressly use the phrase "means for" followed by a statement of function void of further structure.

What is claimed is:

1. A connector system comprising:

a first connector comprising a housing holding a plurality of contacts;

a second connector comprising a housing holding a plurality of contacts; and a metal shield having walls defining a shielded chamber;

wherein the first and second connectors are configured to be mounted to a circuit board in a stacked arrangement next to one another, the first and second connectors are configured to be arranged in a shielded configuration in which the first and second connectors are positioned within the shielded chamber and mounted to the circuit board with the metal shield and the first and second connectors are configured to be arranged in an unshielded configuration in which the first and second connectors are mounted to the circuit board without the metal shield; and wherein the housings define mating interfaces for mating with corresponding mating connectors, the first and second connectors received in the metal shield without affecting the mating interfaces such that the housings are configured to be mated to the mating connectors in the shielded configuration and in the unshielded configuration.

2. The connector system of claim 1, wherein the metal shield has an open bottom, the contacts extending through the open bottom for electrical connection to the circuit board.

3. The connector system of claim 1, wherein the shield is stamped and formed.

4. The connector system of claim 1, wherein the shield constitutes a die-cast metal shell.

5. The connector system of claim 1, wherein the metal shield includes tabs extending therefrom, the tabs are configured to engage a complementary metal shield of a mating connector.

6. The connector system of claim 1, wherein the housing includes alignment lugs configured to be received in alignment slots of a mating connector, the metal shield including channels therethrough that receive the alignment lugs.

7. A connector system comprising:

a first connector comprising a housing holding a plurality of contacts;

a second connector comprising a housing holding a plurality of contacts; and a metal shield having walls defining a shielded chamber;

wherein the first and second connectors are configured to be mounted to a circuit board in a stacked arrangement next to one another, the first and second connectors are configured to be arranged in a shielded configuration in which the first and second connectors are positioned within the shielded chamber and mounted to the circuit board with the metal shield and the first and second connectors are configured to be arranged in an unshielded configuration in which the first and second connectors are mounted to the circuit board without the metal shield; and wherein the housings each include a receptacle cavity, the metal shield includes a front edge with clips extending therefrom, the clips include spring fingers extending therefrom into the receptacle cavities of the housings, the spring fingers being configured to engage a complementary metal shield of a mating connector received in the corresponding receptacle cavity.

8. The connector system of claim 7, wherein the metal shield has an open bottom, the contacts extending through the open bottom for electrical connection to the circuit board.

9. The connector system of claim 7, wherein the shield is either a die cast metal shell or a stamped and formed metal shield.

10. The connector system of claim 7, each housing includes a lip, the metal shield includes an edge received between the lip and the housing.

11. The connector system of claim 7, wherein the metal shield includes tabs extending therefrom, the tabs are configured to engage a complementary metal shield of a mating connector.

12. The connector system of claim 7, wherein the housing includes alignment lugs configured to be received in alignment slots of a mating connector, the metal shield including channels therethrough that receive the alignment lugs.

13. A connector system comprising:

a first connector comprising a housing holding a plurality of contacts;

a second connector comprising a housing holding a plurality of contacts; and a metal shield having walls defining a shielded chamber;

wherein the first and second connectors are configured to be mounted to a circuit board in a stacked arrangement next to one another, the first and second connectors are configured to be arranged in a shielded configuration in which the first and second connectors are positioned within the shielded chamber and mounted to the circuit board with the metal shield and the first and second connectors are configured to be arranged in an unshielded configuration in which the first and second connectors are mounted to the circuit board without the metal shield; and wherein each housing includes a lip, the metal shield includes an edge received between the lip and the housing.

14. The connector system of claim 13, wherein the metal shield has an open bottom, the contacts extending through the open bottom for electrical connection to the circuit board.

15. The connector system of claim 13, wherein the shield is either a die cast metal shell or a stamped and formed metal shield.

16. The connector system of claim 13, wherein the metal shield includes tabs extending therefrom, the tabs are configured to engage a complementary metal shield of a mating connector.

17. The connector system of claim 13, wherein the housing includes alignment lugs configured to be received in alignment slots of a mating connector, the metal shield including channels therethrough that receive the alignment lugs.

* * * * *